US006654575B2

(12) United States Patent
Miura et al.

(10) Patent No.: US 6,654,575 B2
(45) Date of Patent: Nov. 25, 2003

(54) DEVELOPER CONTAINER HAVING SEALING MEMBER

(75) Inventors: Toshihiko Miura, Ibaraki (JP); Masatoshi Kato, Ibaraki (JP); Kanji Yokomori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/990,347

(22) Filed: Nov. 23, 2001

(65) Prior Publication Data

US 2002/0064392 A1 May 30, 2002

(30) Foreign Application Priority Data

| | | |
|---|---|---|
| Nov. 28, 2000 | (JP) | 2000-361108 |
| Nov. 28, 2000 | (JP) | 2000-361117 |
| Jan. 11, 2001 | (JP) | 2001-003999 |
| Jan. 11, 2001 | (JP) | 2001-004003 |

(51) Int. Cl.[7] ..... G03G 15/08
(52) U.S. Cl. ..... 399/102; 399/105; 399/106
(58) Field of Search ..... 399/102, 103, 399/105, 106, 111, 119

(56) References Cited

U.S. PATENT DOCUMENTS

| | | | | |
|---|---|---|---|---|
| 5,208,634 A | | 5/1993 | Ikemoto et al. | 399/111 |
| 5,294,960 A | | 3/1994 | Nomura et al. | 399/113 |
| 5,561,504 A | * | 10/1996 | Watanabe et al. | 399/111 |
| 5,740,499 A | * | 4/1998 | Higeta et al. | 399/105 |
| 5,809,374 A | * | 9/1998 | Tsuda et al. | 399/111 |
| 6,002,898 A | | 12/1999 | Yokomori et al. | 399/119 |

FOREIGN PATENT DOCUMENTS

| | | |
|---|---|---|
| JP | 4-9869 | 1/1992 |
| JP | 4-289869 | 10/1992 |

* cited by examiner

*Primary Examiner*—Hoan Tran
(74) *Attorney, Agent, or Firm*—Fitzpatrick, Cella, Harper & Scinto

(57) ABSTRACT

A developer container includes a developer containing unit containing a developer and a sealing member supplied between a plurality of members to prevent leakage of the developer. The sealing member is a liquid elastomer. In an area in which the liquid elastomer is supplied, supply amounts of the sealing member at a start point and end point are larger than a supply amount of the sealing member in an intermediate portion.

30 Claims, 18 Drawing Sheets

DEVELOPER CONTAINER HAVING SEALING MEMBER

BACKGROUND OF THE INVENTION

1. Field of the Invention

The present invention relates to a developer container containing a developer and, more particularly, to a developer container having a sealing member for preventing a leak of a developer. This developer container is preferably used in an image forming apparatus such as an electrophotographic copying machine or a laser beam printer.

2. Related Background Art

A detachable toner cartridge of an image forming apparatus has a structure in which, in order to prevent a leak of toner as a developer when the toner cartridge is installed or removed or while it is used, a gap between a container containing the developer and an assembling member assembled to this container is sealed by adhering a urethane sponge or applying a liquid elastomer to the gap (Japanese Patent Application Laid-Open Nos. 4-289869 and 4-9869).

To seal the gap by adhering the urethane sponge, the sponge is manually adhered to the container or the like by using, e.g., a double-coated tape adhered to the sponge beforehand. This work is labor intensive, and the adhesion is difficult and time-consuming.

If the purpose is sealing with no sliding of the parts, the use of sealing by application of a liquid elastomer is known. This application of a liquid elastomer uses automatic application using a dispenser. This automatic application has a working efficiency higher than that of manual work. In a method in which a liquid elastomer is linearly applied to a container as a junction surface with respect to an assembling member, a dispenser is mounted on an NC robot, and the liquid elastomer is discharged in constant amount while the position of the dispenser is controlled along the shape of the container. In this method, the application area has a closed loop locus having the start and end points at the same position. In this application area having a closed loop locus, application is performed such that the start and end points are the same or overlap each other. Even if the application amounts at the start and end points are different, it is possible to ensure a sufficient application amount and high sealing properties.

Possible causes of variations in the application amount are as follows:

Unfortunately, when a liquid elastomer is applied to a gap between a container containing a developer and an assembling member, the application locus cannot be a closed loop depending on the shape of this assembling member. If application is performed by a linear locus, a large difference is produced between the application amounts within the range of the start and end points in the application area, for the reasons explained below.

That is, liquid elastomers are classified into one-component thermoplastic type, two-component type which solidifies by mixing, and the like. Any of these types is a medium- to high-viscosity liquid. When application is performed using a dispenser, the actual application amount largely varies with respect to the opening/closing of a nozzle, because the application amounts at the start and end points in the application area are unstable owing to low discharge response caused by viscosity, the presence/absence of solid matter (the residue of previous application) at the tip of the nozzle, and the like. If the application amount is small, no sufficient sealing properties can be ensured, resulting in a defective product with a toner leak.

To stabilize the initial application amount, it is also possible to combine a method which performs preliminary discharge in a location other than the application area immediately before application. However, this increases the number of operation steps before application, and lowers the productivity by prolonging the tact time.

Alternatively, a liquid elastomer (two-component reaction type) disclosed in Japanese Patent Application Laid-Open No. 4-289869 is applied or injected as a sealing agent and aged for foaming, and parts are assembled after that.

As a liquid elastomer requiring no aging for foaming and capable of being injected into a gap after parts assembly, a one-component elastomer (trade name: "FOAM MELT") obtained by liquefying thermoplastic synthetic rubber with heat and mixing an inert gas is known. This one-component elastomer is a medium- to high-viscosity liquid and must be maintained in a high-temperature liquid state immediately before injection. A dispenser used in the injection is a valve unit with a circulating hose having a built-in heater. The elastomer is discharged by opening/closing the on-off valve in the end portion of the dispenser.

In the above prior art, however, the valve unit structure with a circulating hose having a built-in heater is used to inject the liquid elastomer to the gap between the container containing a developer and an assembling member. Since the size of this dispenser is large, the space is limited with respect to the injection position of the container. Also, the impingement position of the liquid elastomer discharged from the nozzle varies owing to the dispenser internal pressure, the presence/absence of solid matter (the residue of previous application) at the nozzle tip, and the state of the nozzle opening surface.

If the impingement position of the liquid elastomer deviates to make it impossible to fill an injection groove with the liquid elastomer, no sufficient sealing properties can be assured, resulting in a defective product with a toner leak.

FIG. 12 shows the elastomer application state in this case. The injection position of a dispenser 11 with respect to a container 1 is set above an elastomer injection area a shown in FIG. 12 (this injection area a is a gap between a blade 2 and the container 1). That portion extending from a nozzle 17, which is indicated by the dotted lines is an elastomer impingement area a. This elastomer impingement area a has the same width as the elastomer injection area a. However, if impingement area>injection area, the elastomer cannot be injected into a predetermined area in some instances, as indicated by an elastomer 19.

In addition, with the recent increase in required image quality, the toner particle size is being more and more decreased. This makes it difficult to well prevent a toner leak only by simply injecting a liquid elastomer into a gap between toner cartridge parts assembled beforehand.

SUMMARY OF THE INVENTION

It is an object of the present invention to provide a developer container which reliably prevents a leak of a developer.

It is another object of the present invention to provide a developer container capable of improving the productivity for the formation of a sealing member.

It is still another object of the present invention to provide a developer container capable of reliably preventing a leak of toner having a small particle size, regardless of the dimensional tolerance or assembly tolerance of parts.

Other objects, features and advantages of the invention will become apparent from the following detailed description taken in conjunction with the accompanying drawings.

DESCRIPTION OF THE PREFERRED EMBODIMENTS

Embodiments of the present invention will be described below with reference to the accompanying drawings.

Figure 2:
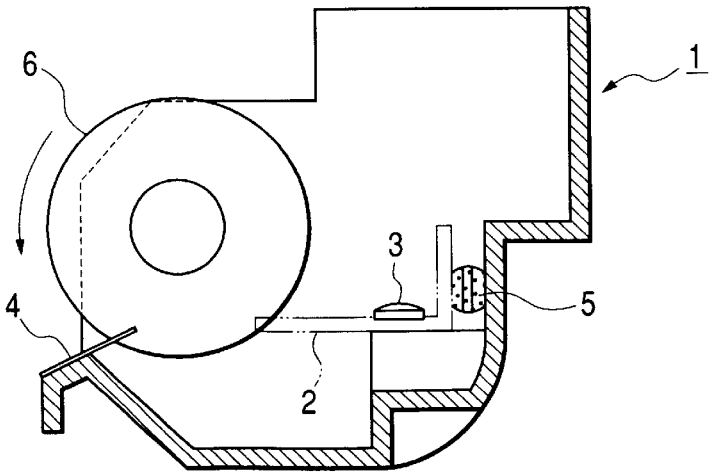
FIG. 2 is a sectional view of the vessel constructing the toner cartridge of this embodiment.

FIG. 2 is a sectional view of a cleaner vessel (vessel body) 1 as a developer container constructing a toner cartridge (process cartridge) which can be installed in and removed from the body of an image forming apparatus. A cleaning blade 2 indicated by the two-dot chain line is attached to the vessel 1. Two side portions of this cleaning blade 2 are fixed to the vessel 1 by machine screws 3. The cleaning blade 2 comes in contact with a photosensitive drum 6 as an image carrier, and removes residual toner from this image carrier. The removed toner is contained in the cleaner vessel 1.

A sheet 4 is adhered to the vessel 1 by a double-coated tape (not shown). When the drum 6 is attached to the vessel 1, the surface of this sheet 4 and an edge rubber portion of the blade 2 form a closed vessel. Waste toner (waste developer) is collected in this closed vessel.

A plastic resin molded product is used as the vessel 1, and a gap is formed between this vessel 1 and the blade 2 in relation to the molding accuracy. When this gap is formed, the waste toner (waste developer) collected in the closed vessel leaks to result in a defective product. Therefore, this leak of the waste toner is prevented by applying a liquid elastomer 5 as a sealing agent to the gap.

Figure 1:
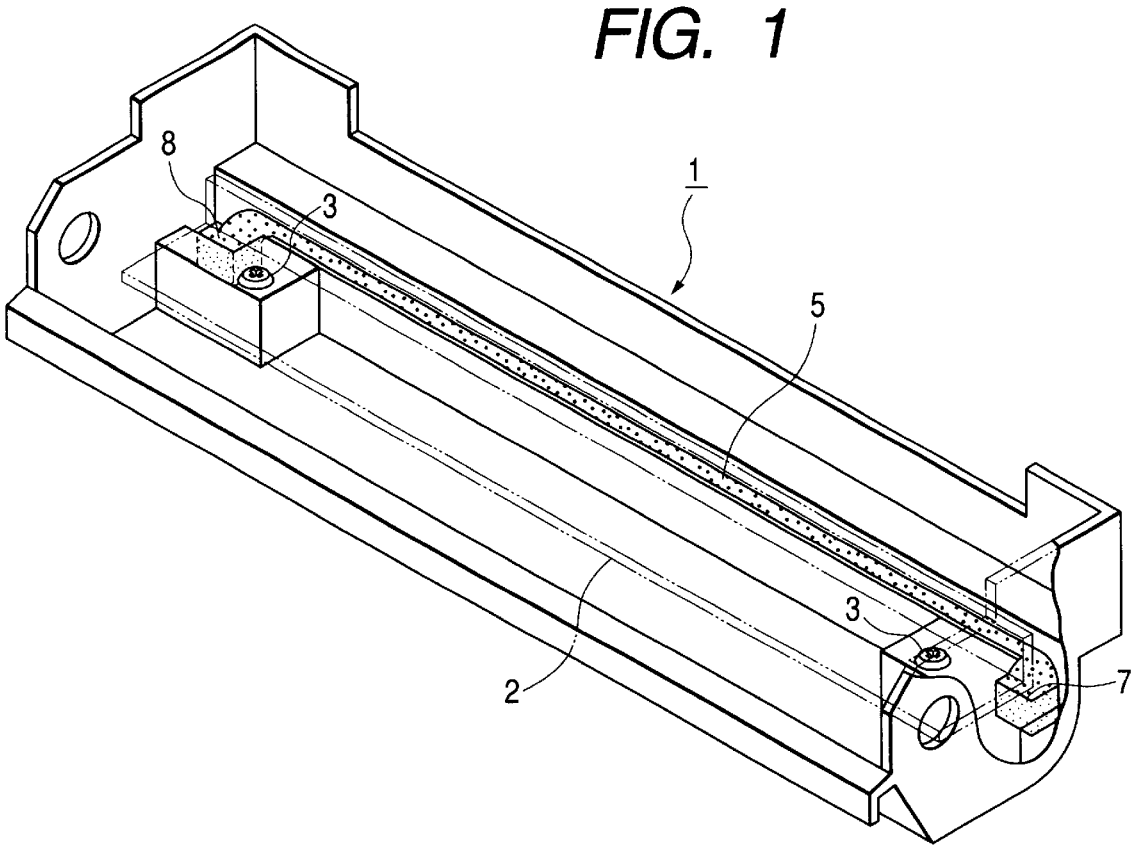
FIG. 1 is a perspective view of a vessel constructing a toner cartridge of this embodiment.

FIG. 1 is a perspective view of the cleaner vessel 1, and shows the state in which the blade 2 is mounted on the vessel 1 by the machine screws 3. The surfaces at which this blade 2 is mounted on the vessel 1 are formed in the two side portions of the blade 2, in order to ensure a large waste toner volume and increase the adhesion to the blade 2. Although the blade 2 and the vessel 1 are closely adhered in these mounting surface portions, a linear gap is formed along the longitudinal direction of the blade 2. Hence, the liquid elastomer 5 is applied along this gap to a portion shown in FIG. 1.

At the two ends of the portion of the vessel 1 where the blade 2 is positioned, reservoir grooves 7 and 8 which are square holes are formed in the same direction as the mounting direction of the blade 2. These reservoir grooves 7 and 8 are positioned at the start point (leading end portion) and the end point (trailing end portion) of the application area of the liquid elastomer 5. The reservoir grooves 7 and 8 have a volume larger than the application volume in the intermediate portion of the blade 2.

Figure 3:
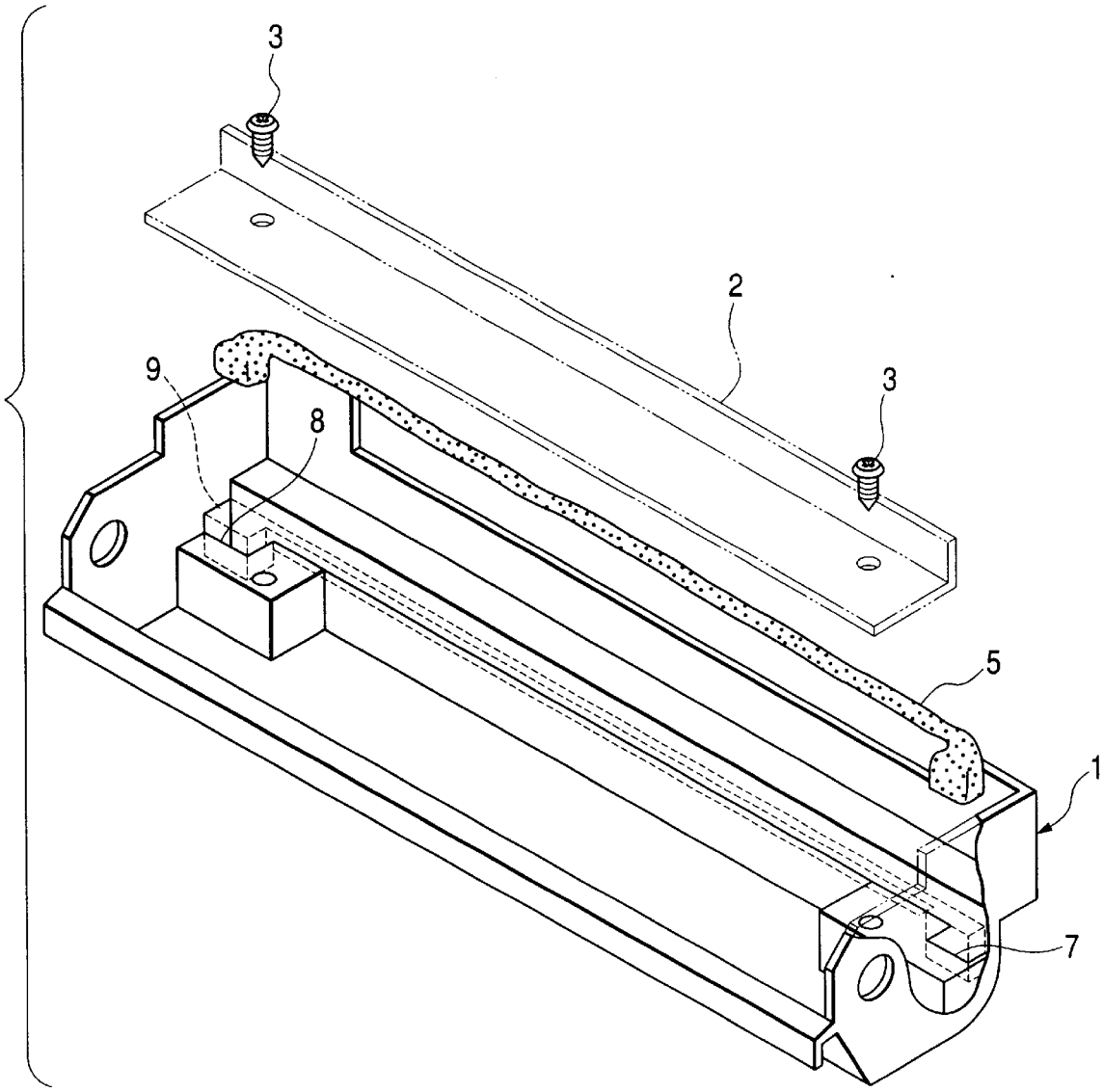
FIG. 3 is a perspective view showing the state in which a blade and the solidified shape of a liquid elastomer are separated upward from the vessel, in order to explain the application area of the liquid elastomer.

FIG. 3 shows the state in which the blade 2 and the solidified shape of the liquid elastomer 5 are separated upward from the vessel 1, in order to explain the application area of the liquid elastomer 5 shown in FIG. 1. When the liquid elastomer 5 applied to the gap between the blade 2 and the vessel 1 is extracted from the vessel 1, its solidified shape traces the shape of an application area 9 indicated by the dotted lines in FIG. 3.

Figure 4:
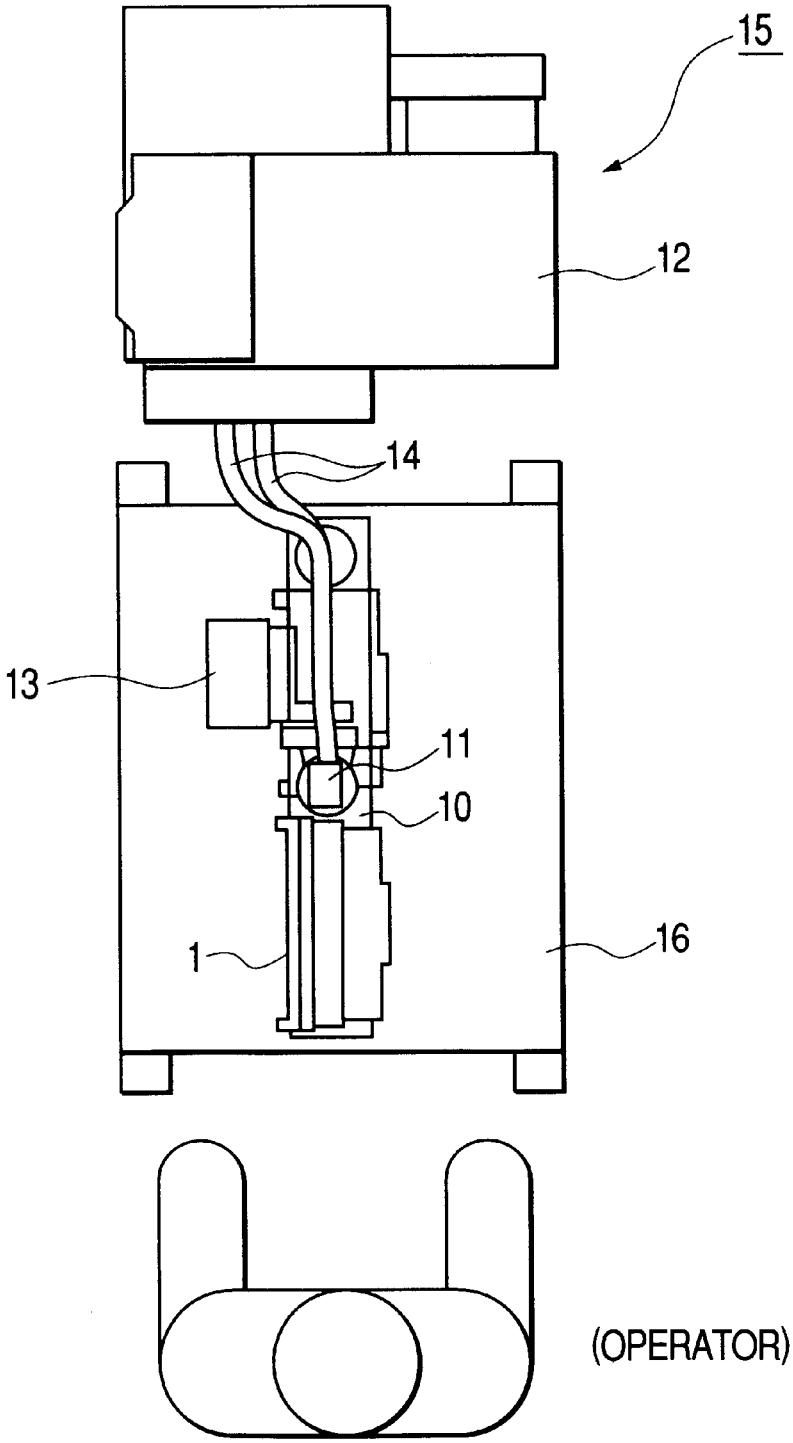
FIG. 4 is a plan view of an applicator.

FIG. 4 is a plan view of an applicator 15 for applying the liquid elastomer 5. This applicator 15 shown in FIG. 4 comprises a tooling unit on a table 16 on which application is performed, and a supply unit 12 of the liquid elastomer 5. Note that the liquid elastomer 5 used in the supply unit 12 is a thermoplastic synthetic rubber material which solidifies at room temperature.

This supply unit 12 melts the rubber material by heating to 160 to 180° C. and mixes this molten rubber material with a separately supplied gas such as an inert gas, thereby obtaining the medium- to high-viscosity liquid elastomer 5 containing fine cells. This liquid elastomer 5 containing fine cells is supplied in the liquid state to a dispenser 11 through hoses 14 and applied. The hoses 14 are used to stably circulate the liquid elastomer 5 in the liquid state between the supply unit 12 and the dispenser 11. A heater (not shown) is formed on the entire outer circumferential surface of each hose. These hoses 14 are a supply hose and return hose for giving the liquid elastomer 5 a material temperature of 160 to 180° C. and circulating this liquid elastomer 5 held in the liquid state between the supply unit 12 and the dispenser 11. Therefore, these two hoses 14 are connected to the dispenser 11.

This dispenser 11 is fixed to a support 13 placed on the table 16. An NC linear motion unit 10 is placed on the lower surface of the dispenser 11 fixed to the support 13. The vessel 1 as a work is placed on a moving base of this NC linear motion unit 10. The valve of the dispenser 11 opens and closes in synchronism with the movement of the NC linear motion unit 10.

Figure 5A:
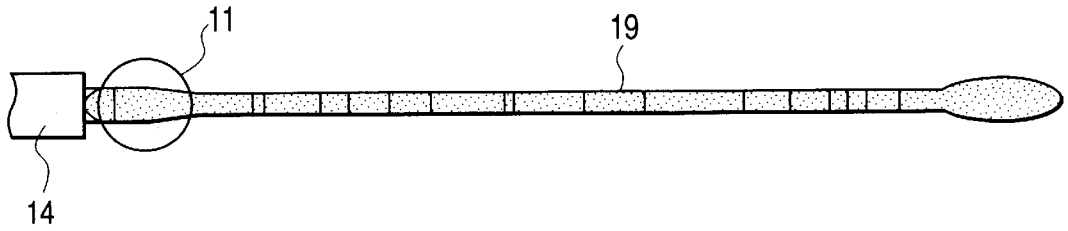
FIGS. 5A and 5B are views showing the sectional shape of a dispenser and the applied state of the liquid elastomer.
Figure 5B:
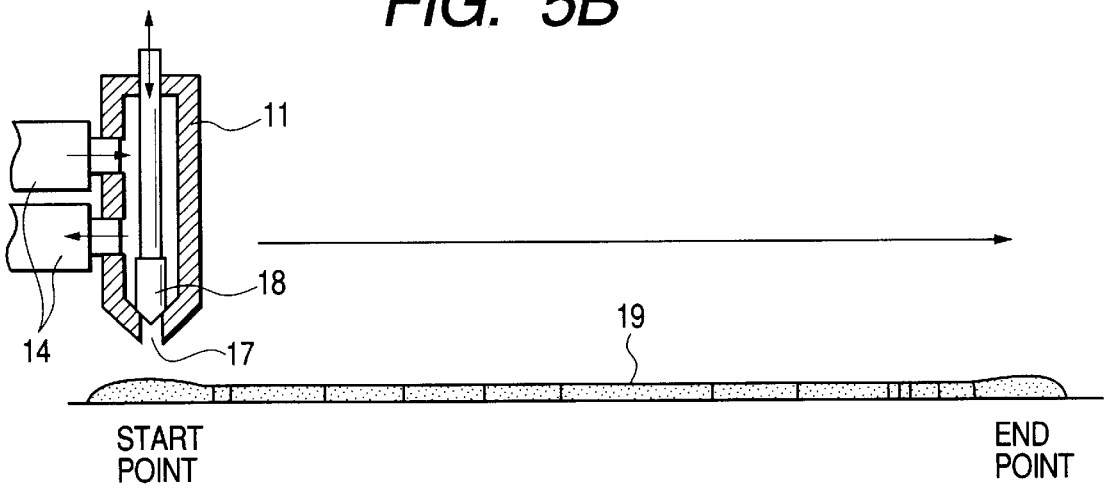

FIGS. 5A and 5B illustrate the sectional shape of the dispenser 11 and the applied state of the liquid elastomer 5. FIG. 5A is a plan view, and FIG. 5B is a side view.

As shown in FIGS. 5A and 5B, the molten liquid elastomer (containing fine cells) 5 circulates in the dispenser 11 through the hoses 14. An on-off valve 18 is formed in a nozzle 17 of the dispenser 11. The nozzle 17 is opened by opening this on-off valve 18 by raising it by a solenoid or the like, and the circulating liquid elastomer 5 is discharged by the internal pressure of the hoses 14. By linearly moving the nozzle 17 or the vessel 1 as a work in synchronism with this discharge, the liquid elastomer 5 can be linearly applied.

The liquid elastomer 5 discharged from the nozzle 17 begins solidifying because its temperature lowers along with the expansion of the mixed fine cells. When the liquid elastomer 5 solidifies, an elastomer 19 having the shape as shown in FIG. 5B is obtained. The application amounts of this elastomer 19 in the start and end portions vary more largely than the application amount in the intermediate portion. Toner may leak in a portion where the application amount is small owing to these variations.

Possible causes of variations in the application amount are as follows.

Since the liquid elastomer 5 is a medium- to high-viscosity liquid, liquid discharge does not well respond to the opening/closing action of the nozzle 17 of the dispenser 11.

If the residue of previous application at the tip of the nozzle 17 solidifies, the application amount at the start point becomes unstable.

The tip of the nozzle 17 has a portion where the liquid does not circulate. If the liquid stays there, the viscosity of the liquid changes owing to a density difference between mixed cells.

When the liquid elastomer 5 is to be linearly applied, variations in actual discharge timings at the start and end points make it difficult to synchronize the application with the movement of the NC linear motion unit 10.

Referring to FIG. 4, an operator places the vessel 1 on the moving base of the NC linear motion unit 10 and presses a start switch (not shown). Consequently, the vessel 1 is moved by the NC linear motion unit 10, and the start point of the application area is positioned at the center of the nozzle 17 of the dispenser 11.

Figure 6:
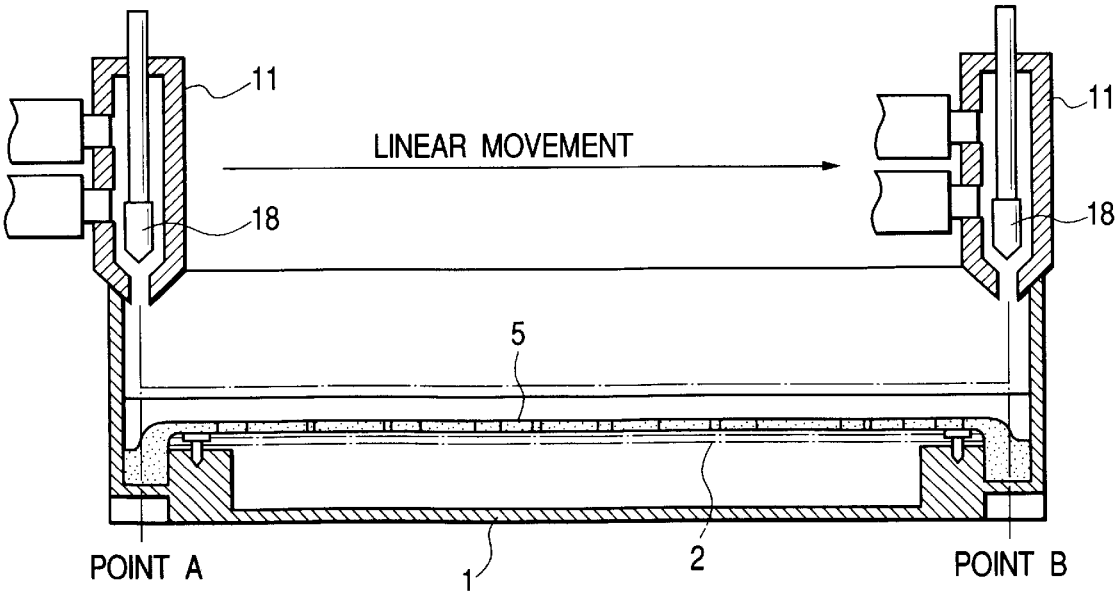
FIG. 6 is a sectional view showing the state in which the liquid elastomer is applied to the vessel, and the method of application.

FIG. 6 is a sectional view showing the state in which the liquid elastomer 5 is applied to the vessel 1, and the method of application.

Referring to FIG. 6, a point A is an application start point. At this point A, the on-off valve 18 of the dispenser 11 is opened. Note that this opening of the on-off valve 18 is done under time control by a timer, and the application amount is determined by the opening time of this on-off valve 18.

With the on-off valve 18 open, the NC linear motion unit 10 is moved to apply the liquid elastomer 5 to the gap between the blade 2 and the vessel 1. The discharge amount per unit time by the opening of the on-off valve 18 is constant. Between the start point (point A) and the end point (point B), therefore, the application amount is determined by the moving speed of the NC linear motion unit 10.

When the dispenser 11 arrives at the point B as the application end point, this dispenser 11 is stopped as in the point A, and time control is performed by the timer such that the on-off valve 18 is closed after an elapse of a predetermined time.

In the above application method, the relationship between the moving velocity in the intermediate application area and the stop time in the two end portions (start and end points) of the NC linear motion unit 10 is so set as to increase the application volumes in the two end portions (start and end points) in the application area of the vessel 1.

In this embodiment, the hole-like reservoir grooves 7 and 8 for making the application amounts in these portions larger than the intermediate application amount are formed in the start and end portions of the area of the vessel 1 where the liquid elastomer 5 is applied or injected. Accordingly, the application amounts at the start and end points of the application area become stable, and this eliminates variations in the application amount. As a consequence, it is possible to ensure high sealing properties of the toner cartridge and reliably prevent a toner leak.

This also obviates the need for the initial application amount stabilization step such as preliminary discharge performed immediately before application in a location other than the application area. Consequently, the productivity of the toner cartridge increases.

Figure 7:
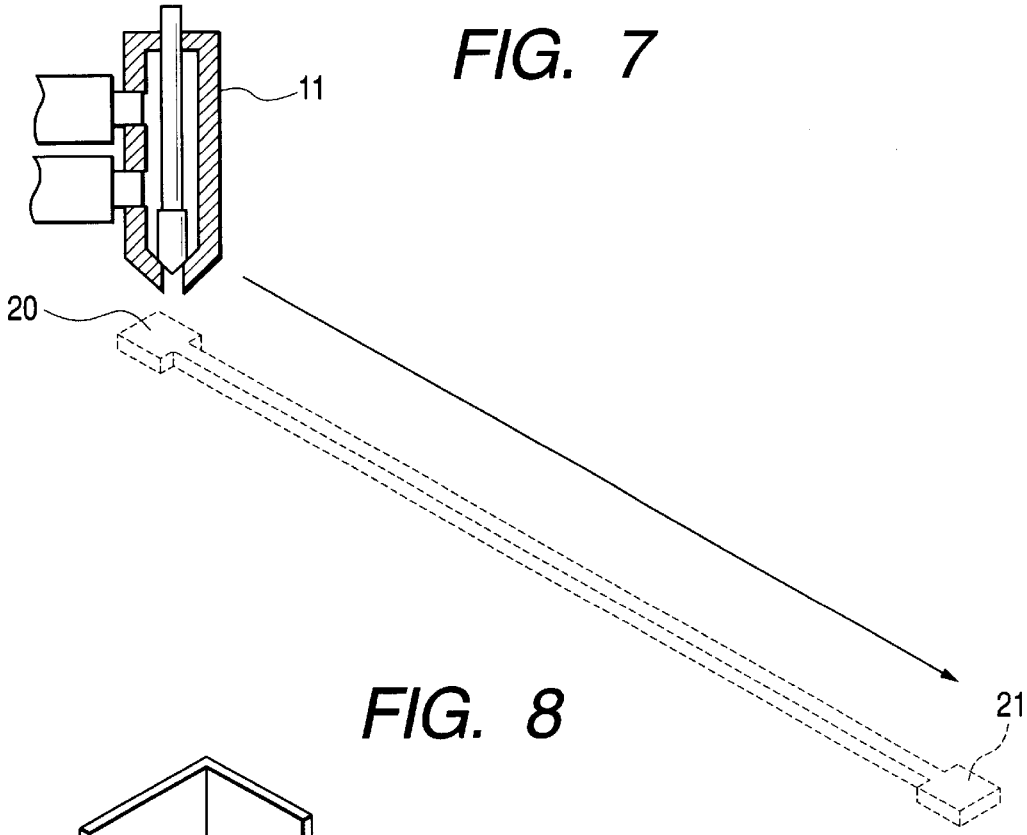
FIG. 7 is a perspective view showing the state in which the application volumes in the two end portions (start and end points) are horizontally increased with respect to the application volume in the intermediate application area.

FIG. 7 shows a modification different from the above embodiment. That is, FIG. 7 is a perspective view showing the state in which the application volumes in the two end portions (start and end points) are horizontally increased with respect to the application volume in the intermediate application area. In this modification, reservoir grooves 20 and 21 for applying a liquid elastomer to the start and end portions of the application or injection area, in amount larger than the intermediate application amount, are formed in a toner cartridge vessel.

In this embodiment as described above, a toner cartridge is constructed by containing a developer in a vessel formed by connecting a plurality of members, and applying or injecting a liquid elastomer as a sealing agent into a gap between these members, thereby sealing this gap. In this toner cartridge, holes for making the application amount larger than the intermediate application amount are formed in the start and end portions of the liquid elastomer application or injection area of the vessel. This achieves the effect of reliably preventing a leak of the developer from the toner cartridge and improving the productivity of the toner cartridge.

Another embodiment of the present invention will be described below.

Figure 9:
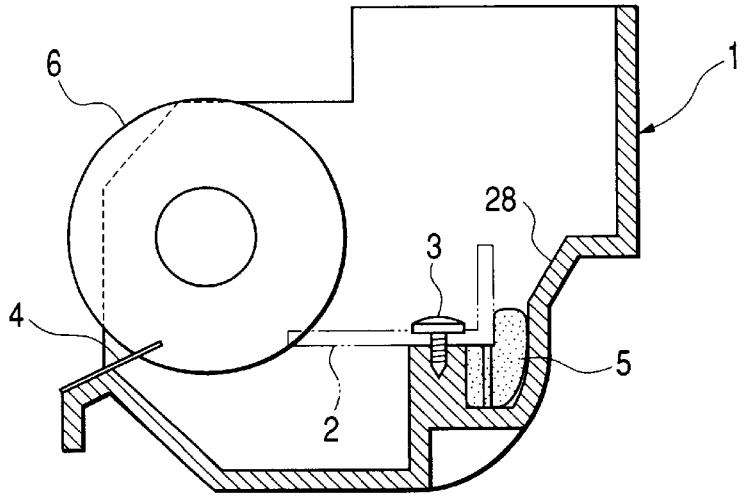
FIG. 9 is a sectional view of the vessel constructing the toner cartridge of this embodiment.

FIG. 9 is a sectional view of a cleaner vessel 1 constructing a toner cartridge. A blade 2 indicated by the two-dot chain line is attached to the vessel 1. That is, two side portions of this blade 2 are fixed to the vessel 1 by machine screws 3.

A sheet 4 is adhered to the vessel 1 by a double-coated tape (not shown). When a drum 6 is attached to the vessel 1, the surface of this sheet 4 and an edge rubber portion of the blade 2 form a closed vessel. Waste toner is collected in this closed vessel.

A plastic resin molded product is used as the vessel 1, and a gap is formed between this vessel 1 and the blade 2 in relation to the molding accuracy. When this gap is formed, the collected waste toner leaks to result in a defective product. Therefore, this leak of the waste toner is prevented by applying or injecting a liquid elastomer 5 as a sealing agent to the gap.

Figure 8:
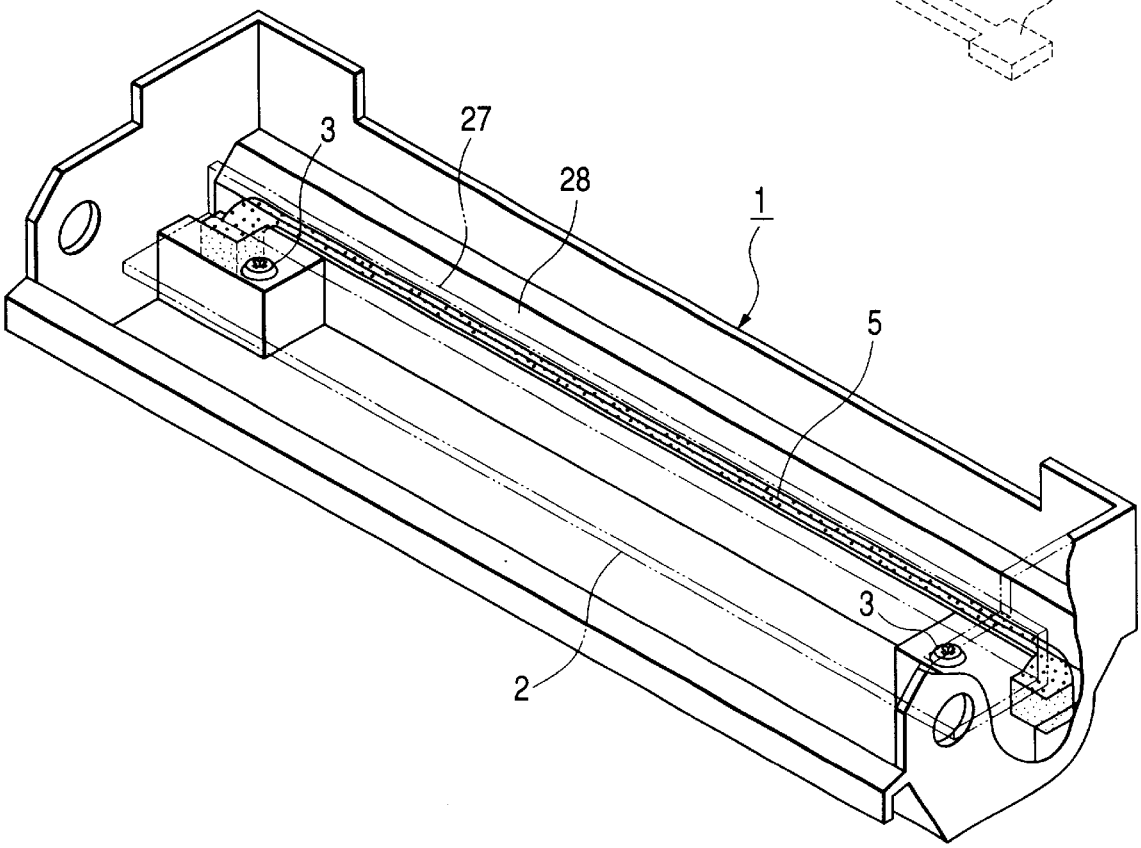
FIG. 8 is a perspective view of a vessel constructing a toner cartridge of another embodiment.

FIG. 8 is a perspective view of the cleaner vessel 1 constructing the toner cartridge of this embodiment, showing the state in which the blade 2 is mounted on the vessel 1 by the machine screws 3. The surfaces at which this blade 2 is mounted on the vessel 1 are formed in the two side portions of the blade 2, in order to ensure a large waste toner volume and increase the adhesion to the blade 2.

Although the blade 2 and the vessel 1 are closely adhered in these mounting surface portions, a linear gap is formed along the longitudinal direction of the blade 2. Hence, the liquid elastomer 5 is applied along this gap as shown FIG. 8.

In a vertical wall portion of the vessel 1, an inclined surface 28 is formed parallel with a vertical bent portion 27 of a support metal plate of the blade 2. This inclined surface 28 is formed over a range covering the entire application area of the liquid elastomer 5 in the longitudinal direction of the blade 2.

Figure 10:
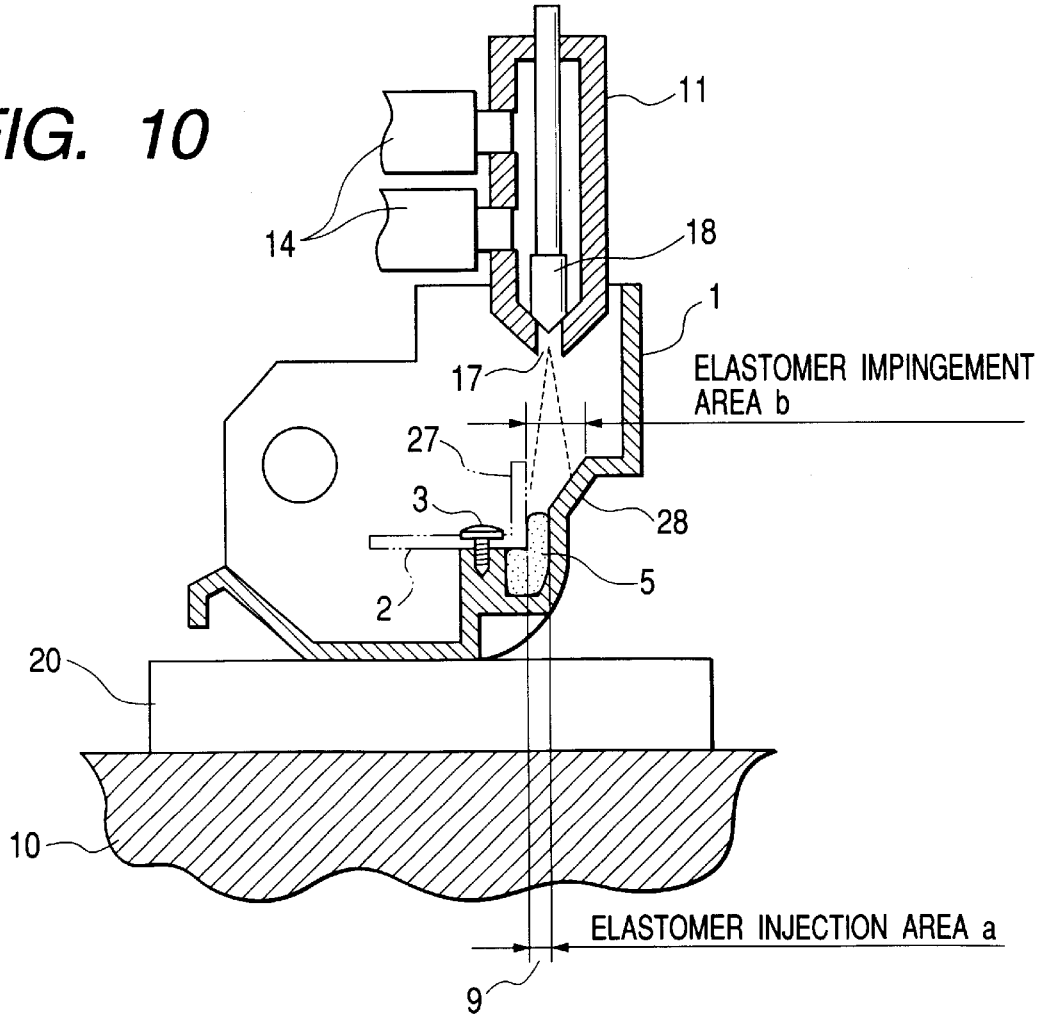
FIG. 10 is a sectional view showing the injection position of a dispenser with respect to the toner cartridge of this embodiment.

FIG. 10 is a sectional view showing the injection position of a dispenser 11 with respect to the toner cartridge.

The vessel 1 is placed on a moving base of an NC linear motion unit 10 for moving the application area. Hoses 14 for circulating the molten liquid elastomer (containing fine cells) 5 are connected to the side portion of the dispenser 11. An on-off valve 18 is formed in a nozzle 17. The nozzle 17 is opened by opening this on-off valve 18 by raising it by a solenoid or the like, and the circulating liquid elastomer 5 is discharged by the internal pressure of the hoses 14.

The impingement position of the liquid elastomer 5 discharged from the nozzle 17 varies in accordance with the internal pressure of the dispenser 11, the presence/absence of solid matter (the residue of previous application) at the tip of the nozzle 17, and the state of the opening surface of the nozzle 17. An area b (FIG. 10) of this impingement position of the liquid elastomer 5 is a dotted line portion from the nozzle 17. Since the inclined surface 28 is formed from the vessel 1 toward the injection opening as described above, the impingement area b covers a portion 9 of an elastomer injection area a. The inclined surface 28 widens the opening through which the liquid elastomer 5 flows. That is, this inclined surface 28 maintains the relationship of impingement area b<injection area a.

To narrow the impingement area of the liquid elastomer 5, the position of the nozzle 17 of the dispenser 11 can be lowered and set closer to the injection area. In this method, however, the vessel 1 and the dispenser 11 may interfere with each other. Although an elevating unit can also be added, the addition of the mechanism unit increases the installation cost. Also, the addition of operating steps increases the tact time and worsens the productivity.

FIG. 4 is a plan view of an applicator 15 for applying the liquid elastomer 5. This applicator 15 shown in FIG. 4 comprises a tooling unit on a table 16 on which application is performed, and a supply unit 12 of the liquid elastomer 5. The liquid elastomer 5 used in the supply unit 12 is a thermoplastic synthetic rubber material which solidifies at room temperature.

The supply unit 12 melts this rubber material by heating to 160 to 180° C. and mixes this molten rubber material with a separately supplied gas such as an inert gas, thereby obtaining the medium- to high-viscosity liquid elastomer 5 containing fine cells. This liquid elastomer 5 containing fine cells is supplied in the liquid state to the dispenser 11 through the hoses 14 and applied. The hoses 14 are used to stably circulate the liquid elastomer 5 containing fine cells in the liquid state between the supply unit 12 and the dispenser 11. A heater (not shown) is formed on the entire outer circumferential surface of each hose. These hoses 14 are a supply hose and return hose for giving the liquid elastomer 5 a material temperature of 160 to 180° C. and circulating this liquid elastomer 5 held in the liquid state between the supply unit 12 and the dispenser 11. Therefore, these two hoses 14 are connected to the dispenser 11.

This dispenser 11 is fixed to a support 13 placed on the table 16. The NC linear motion unit 10 is placed on the lower surface of the dispenser 11 fixed to the support 13. The vessel 1 as a work is placed on a moving base 20 of this NC linear motion unit 10. The on-off valve 18 of the dispenser 11 is opened and closed in synchronism with the movement of the NC linear motion unit 10.

Figure 11:
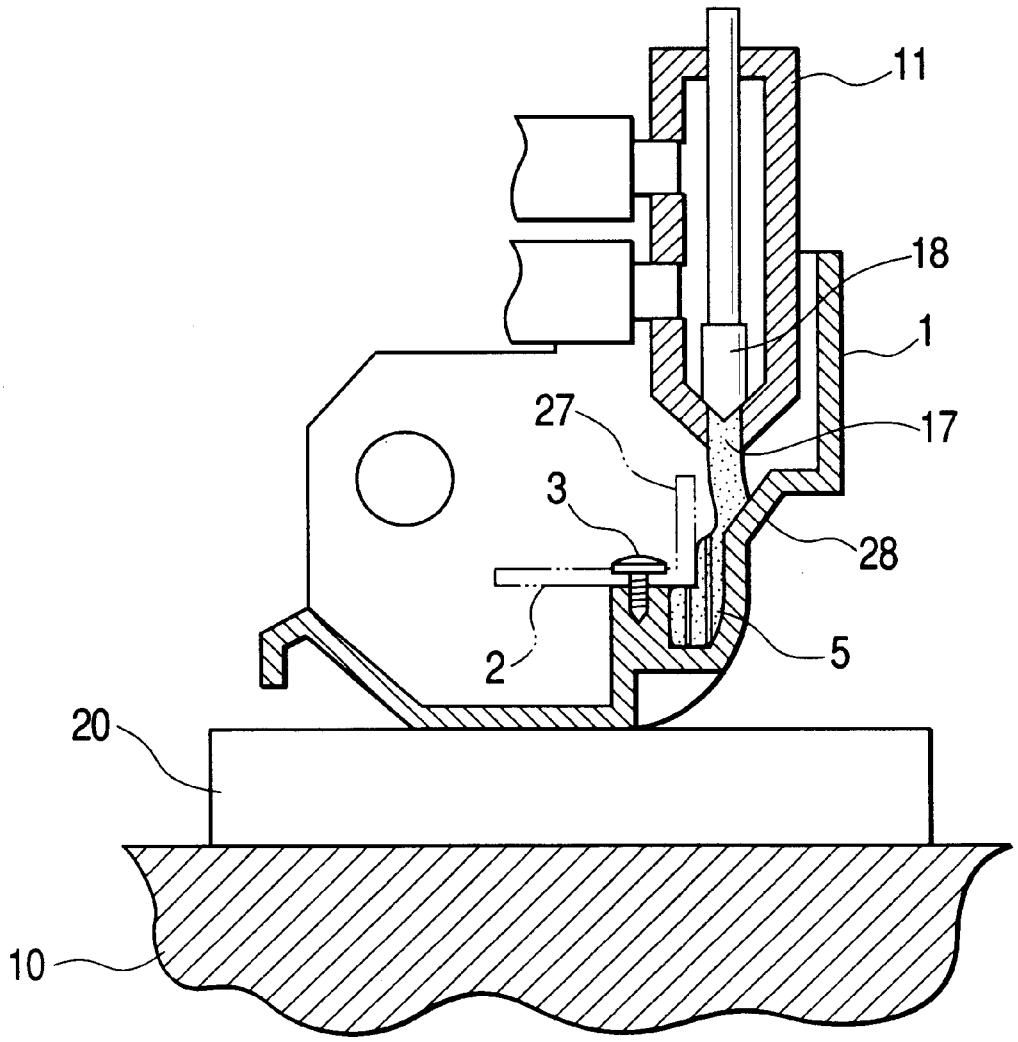
FIG. 11 is a sectional view showing the applied state of a liquid elastomer.
Figure 12:
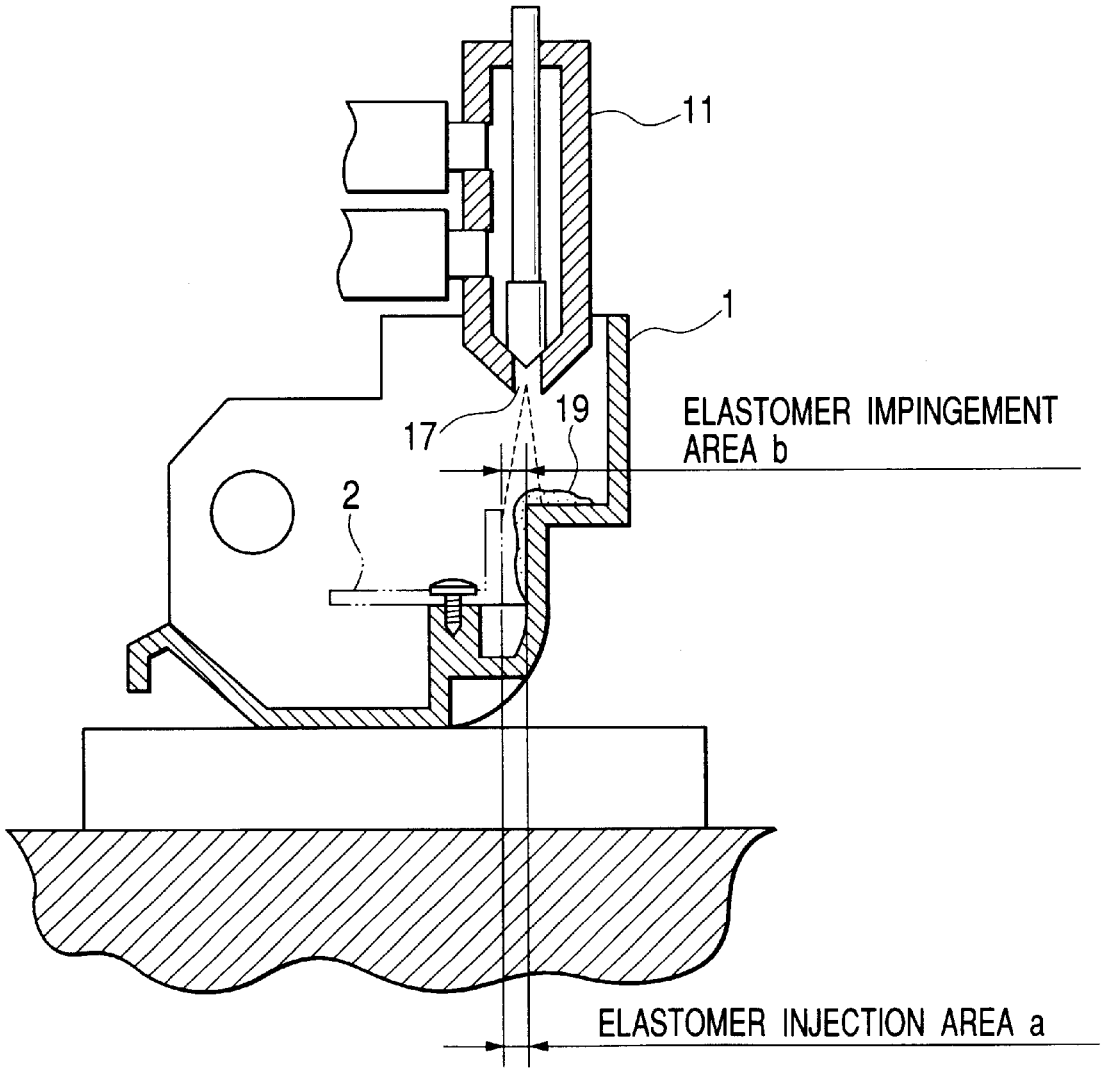
FIG. 12 is a sectional view showing a conventional liquid elastomer applied state.

FIG. 11 is a sectional view showing the applied state of the liquid elastomer 5. That is, FIG. 11 shows the way the liquid elastomer 5 discharged from the nozzle 17 of the dispenser 11 flows into the injection area along the inclined surface 28, even if the impingement position of this liquid elastomer 5 deviates.

Referring to FIG. 4, an operator places the vessel 1 on the moving base 20 of the NC linear motion unit 10 and presses a start switch (not shown). Consequently, the vessel 1 is moved by the NC linear motion unit 10, and the start point of the application area is positioned at the center of the nozzle 17 of the dispenser 11.

FIG. 6 is a sectional view showing the state in which the liquid elastomer 5 is applied to the vessel 1, and the method of application. Referring to FIG. 6, a point Y1 is an application start point. At this point Y1, the on-off valve 18 of the dispenser 11 is opened. This opening of the on-off valve 18 is done under time control by a timer, and the application amount is determined by the opening time of this on-off valve 18.

With the on-off valve 18 open, the NC linear motion unit 10 is moved to apply the liquid elastomer 5 to the gap between the blade 2 and the vessel 1. The discharge amount per unit time by the opening of the on-off valve 18 is constant. Between the start point (point Y1) and the end point (point Y2), therefore, the application amount is determined by the moving speed of the NC linear motion unit 10.

When the dispenser 11 arrives at the point Y2 as the application end point, time control is performed by the timer to close the on-off valve 18 as in the point Y1.

In the above application method, the stop time in the two end portions (start and end points) with respect to the moving velocity in the application area of the NC linear motion unit 10 is so set as to increase the application volumes in the two end portions (start and end points) in the application area of the vessel 1.

In this embodiment as described above, the inclined surface 28 is formed in the vessel 1 to form an opening shape by which the elastomer impingement area b is larger than the elastomer injection area a. Therefore, even if the impingement position of the liquid elastomer 5 deviates, this liquid elastomer 5 reliably flows into the gap between the vessel 1 and the blade 2 along the inclined surface 28, and seals the gap. This reliably prevents a leak of toner from the toner cartridge.

In this embodiment as described above, an inclined surface is formed in a liquid elastomer injection groove of a vessel to form an opening (entrance) shape larger than a deep area of injection. Hence, even if the impingement position of a liquid elastomer deviates, this liquid elastomer reliably flows into the gap between the vessel and a member along the inclined surface, and seals the gap. This achieves the effect of reliably preventing a leak of toner from the toner cartridge.

Still another embodiment of the present invention will be described below with reference to the accompanying drawings.

Figure 14:
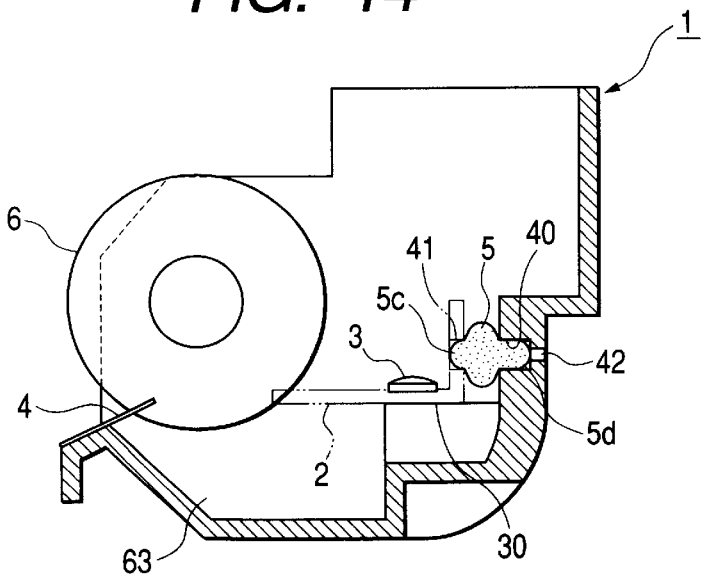
FIG. 14 is a sectional view of the vessel constructing the toner cartridge of this embodiment.

FIG. 14 is a sectional view of a cleaner vessel 1 constructing a toner cartridge of this embodiment. A blade 2 indicated by the two-dot chain line is attached to the vessel 1. This blade 2 is fixed to the vessel 1 by fastening mounting surfaces 30 in two side portions of the blade 2 by machine screws 3.

A sheet 4 is adhered to the vessel 1 by a double-coated tape (not shown). When a drum 6 is attached to the vessel 1, the surface of this sheet 4 and an edge rubber portion of the blade 2 form a closed vessel for collecting waste toner (waste developer).

A plastic resin molded product is used as the vessel 1, and a gap is formed between this vessel 1 and the blade 2 in relation to the molding accuracy. When this gap is formed, the collected waste toner leaks to result in a defective product. Therefore, this leak of the waste toner is prevented by applying a liquid elastomer 5 as a sealing agent.

Figure 13:
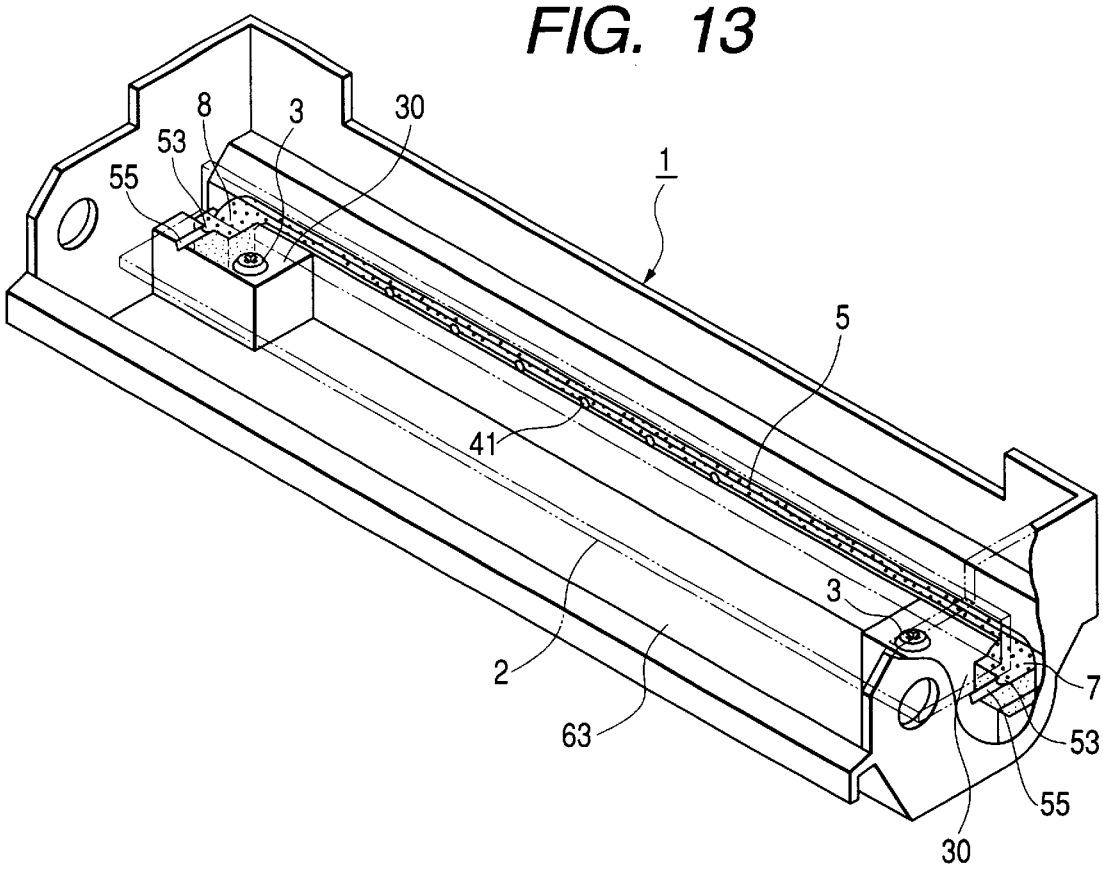
FIG. 13 is a perspective view of a vessel constructing a toner cartridge of still another embodiment.

FIG. 13 is a perspective view of the cleaner vessel 1, showing the state in which the blade 2 is mounted on the vessel 1 by the machine screws 3. The mounting surfaces 30 at which this blade 2 is mounted on the vessel 1 are formed in the two side portions of the blade 2, in order to ensure a large waste toner volume and increase the adhesion to the blade 2.

Although the blade 2 and the vessel 1 are closely adhered on these mounting surfaces 30, a linear gap is formed between the blade 2 and the vessel 1 along the longitudinal direction of the blade 2. Hence, the liquid elastomer 5 is applied along this gap to prevent a toner leak.

In this embodiment, at the two ends of the portion of the vessel 1 where the blade 2 is positioned, reservoir grooves 7 and 8 which are square holes are formed in the same direction as the mounting direction of the blade 2. These reservoir grooves 7 and 8 are positioned at the start and end points, respectively, of the application area of the liquid elastomer 5. The reservoir grooves 7 and 8 have a volume larger than the application volume in the intermediate portion of the blade 2.

Figure 15:
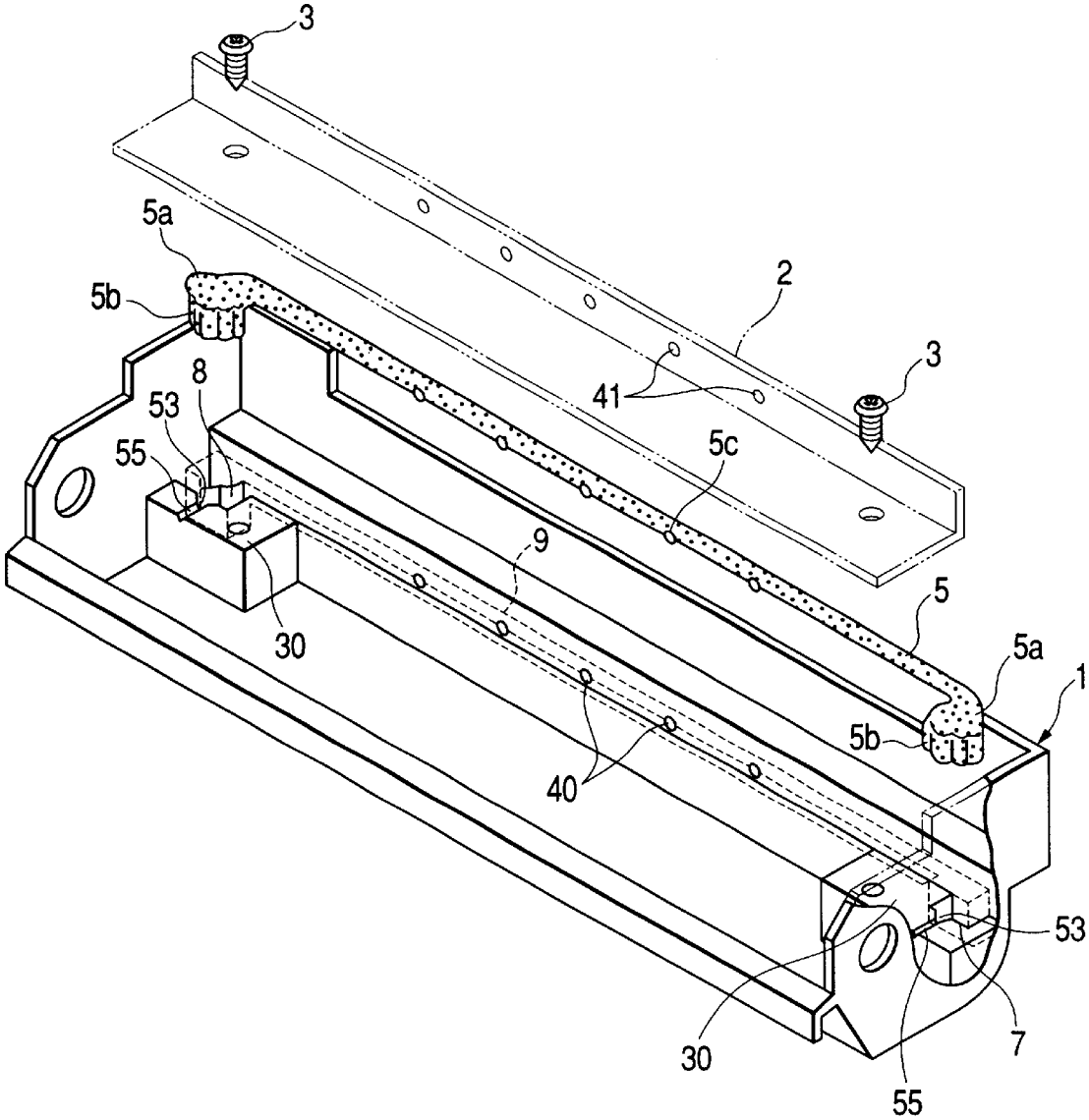
FIG. 15 is a perspective view showing the state in which a blade and the solidified shape of a liquid elastomer are separated upward from the vessel, in order to explain the application area of the liquid elastomer.

FIG. 15 is a perspective view showing the state in which the blade 2 and the solidified shape of the liquid elastomer 5 are separated upward from the vessel 1, in order to explain the application area of the liquid elastomer 5 shown in FIG. 13.

When the liquid elastomer 5 applied to the gap between the blade 2 and the vessel 1 is extracted from the vessel 1, its solidified shape traces the shape of an application area 9 indicated by the dotted lines in FIG. 15. A plurality of through holes 41 are formed in a portion of the blade 2 into which the liquid elastomer 5 is to be injected. An injected liquid elastomer 5*c* is advanced through these through holes 41 to prevent the removal of the injected liquid elastomer 5 and the positional deviation of the liquid elastomer 5 caused by deformation or the like during assembly.

Also, a plurality of recesses 40 are formed in the vessel 1. As shown in FIG. 14, an injected liquid elastomer 5*d* is made to flow into these recesses 40 to prevent the removal of the liquid elastomer 5 and the positional deviation of the liquid elastomer 5 caused by deformation or the like during assembly. In addition, a through hole 42 is formed at the end of each recess 40 as shown in FIG. 14. When the liquid elastomer 5*d* flows into the recess 40, the air in the space of the recess 40 prevents the advance of this liquid elastomer 5*d*. The through hole 42 as an air vent allows smooth advance of the liquid elastomer 5*d* into the recess 40. If the recess 40 itself is formed through the vessel 1, the liquid elastomer 5 overflows to the outside of the vessel 1, and this impairs the external appearance of the vessel 1.

Furthermore, recesses 53 for preventing a toner leak are formed in the blade mounting surfaces 30 of the vessel 1 on the sides of the reservoir grooves 7 and 8. A groove 55 for air ventilation during injection is formed in each recess 53.

Figure 16:
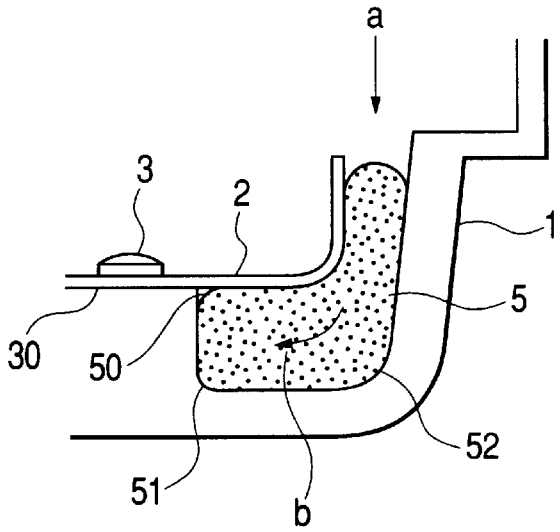
FIG. 16 is a sectional view which illustrates a reservoir groove and its vicinity of a conventional vessel to explain a toner leak.

FIG. 16 is a sectional view showing the state in which the liquid elastomer 5 is injected with no recess 53 formed in the reservoir groove 8. Referring to FIG. 16, the liquid elastomer 5 is discharged in the direction of an arrow a. R portions can be formed in corners 51 and 52 of the vessel 1 in order to improve the transferability to the vessel 1. However, a microscopic gap (space) 50 is formed in a corner between the blade 2 and the blade mounting surface 30.

Figure 17:
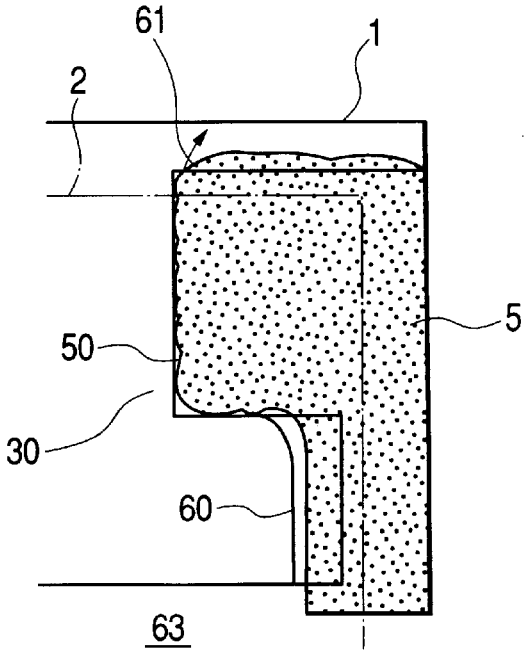
FIG. 17 is a plan view which illustrates the reservoir groove and its vicinity of the conventional vessel to explain a toner leak.

FIG. 17 is a top view of FIG. 16. Referring to FIG. 17, depending on the type of toner the toner passes by the gap 50 through a path 60 from a waste toner chamber 63 and slightly flows out through a path 61, and this may cause a toner leak.

Figure 18:
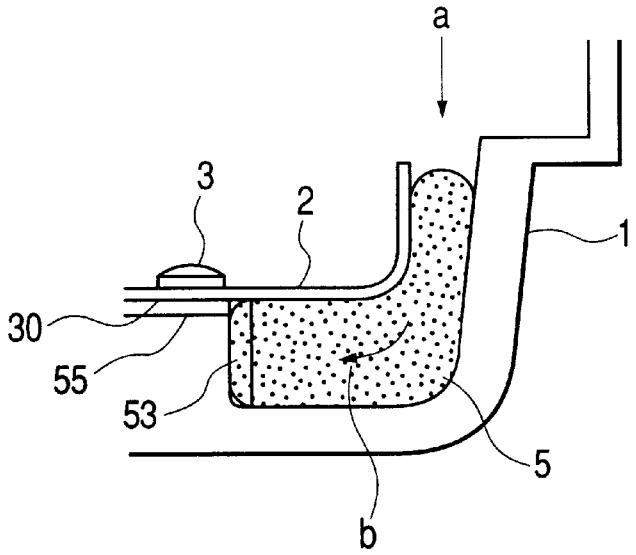
FIG. 18 is a sectional view which illustrates a reservoir groove and its vicinity of a vessel according to the present invention to explain a toner leak.
Figure 19:
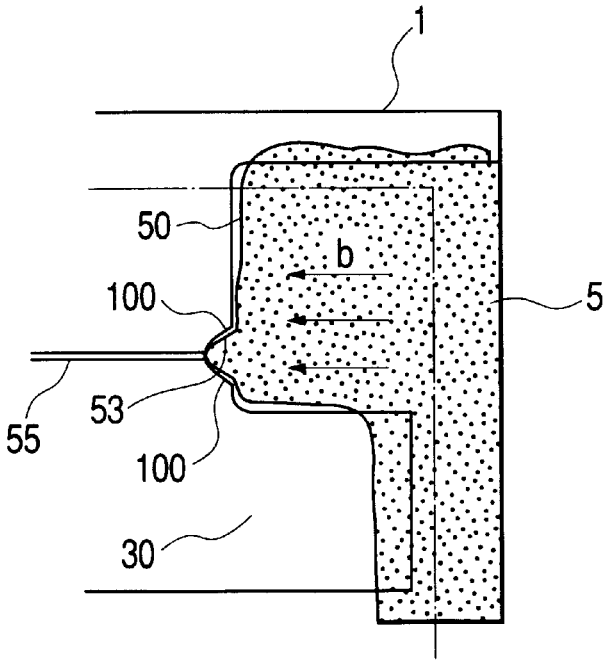
FIG. 19 is a plan view which illustrates the reservoir groove and its vicinity of the vessel according to the present invention to explain a toner leak.
Figure 20:
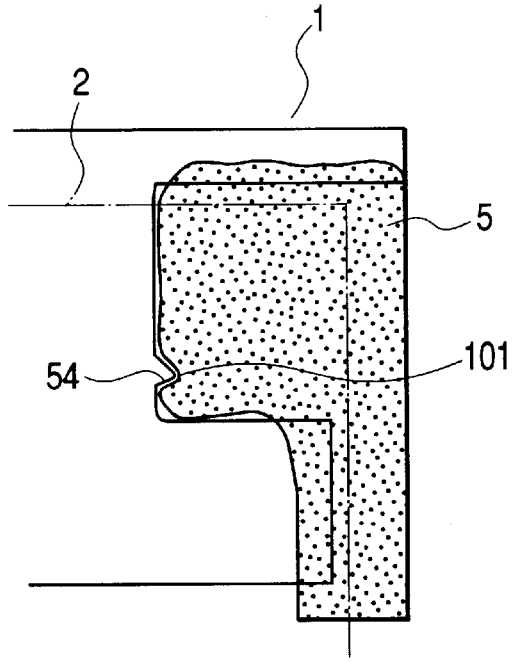
FIG. 20 is a plan view which illustrates a reservoir groove and its vicinity of a vessel according to another form of the present invention to explain a toner leak.

FIG. 18 shows the section of the reservoir groove 8 having the recess 53 according to this embodiment. FIG. 19 is a schematic top view of FIG. 18. The liquid elastomer 5 injected in the direction of an arrow a in FIG. 18 further flows in the direction of an arrow b. The stress by the injection focuses on edges 100 on the two sides of the recess 53. This makes gaps in the vicinities of these edges 100 much smaller than another gap 50, thereby completely stopping the flow of toner. This effect increases as the viscosity of the liquid elastomer 5 is lowered or as the injection pressure is raised. As shown in FIG. 20, a similar effect can be obtained by an edge 101 having the shape of a projection 54, as well as the recessed shape.

Figure 21:
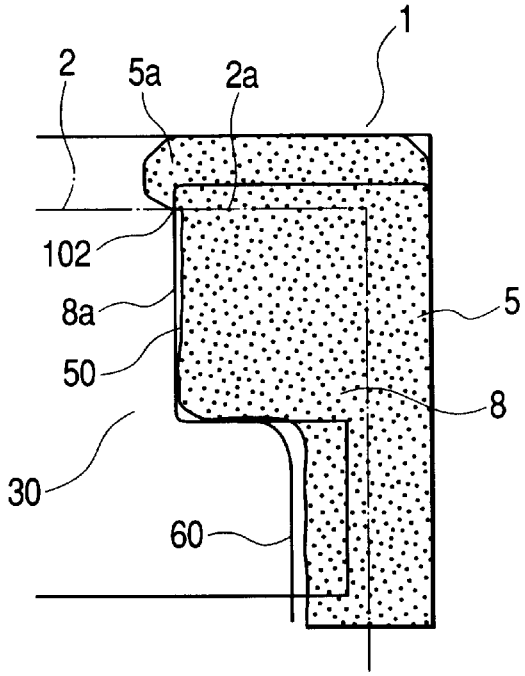
FIG. 21 is a plan view which illustrates a reservoir groove and its vicinity of a vessel according to still another form the present invention to explain a toner leak.

Also, as shown in FIG. 21, a toner leak can be similarly prevented by protruding an liquid elastomer 5*a* to the outer periphery of the blade 2, thereby focusing the injection stress upon an intersection 102 of an edge line 8*a* of the reservoir groove 8 and an edge line 2*a* of the blade 2.

FIG. 4 is a plan view of an applicator 15 for applying the liquid elastomer 5. This applicator 15 shown in FIG. 4 comprises a tooling unit on a table 16 on which application is performed, and a supply unit 12 of the liquid elastomer 5. The liquid elastomer 5 used in the supply unit 12 is a thermoplastic synthetic rubber material which solidifies at room temperature.

This supply unit 12 melts the rubber material by heating to 160 to 180° C. and mixes this molten rubber material with a separately supplied gas such as an inert gas, e.g., nitrogen or carbon dioxide, thereby obtaining the medium- to high-viscosity liquid elastomer 5 containing fine cells. This liquid elastomer 5 containing fine cells is supplied in the liquid state to a dispenser 11 through hoses 14 and applied. The hoses 14 are used to stably circulate the liquid elastomer 5 containing fine cells in the liquid state between the supply unit 12 and the dispenser 11. A heater (not shown) is formed on the entire outer circumferential surface of each hose. These hoses 14 are a supply hose and return hose for giving the liquid elastomer 5 a material temperature of 160 to 180° C. and circulating this liquid elastomer 5 held in the liquid state between the supply unit 12 and the dispenser 11. Therefore, these two hoses 14 are connected to the dispenser 11.

This dispenser 11 is fixed to a support 13 placed on the table 16. An NC linear motion unit 10 is placed on the lower surface of the dispenser 11 fixed to the support 13. The vessel 1 as a work is placed on a moving base of this NC linear motion unit 10. An on-off valve 18 (FIGS. 5A, 5B and 6) of the dispenser 11 is opened and closed in synchronism with the movement of the NC linear motion unit 10. Note that the modulus of elasticity of the solidified elastomer can be decreased by increasing the ratio of the inert gas such as nitrogen gas mixed in the liquid elastomer 5 (the inert gas can be mixed in amount about three times the amount of the liquid elastomer 5 or more as a volume ratio).

FIGS. 5A and 5B illustrate the sectional shape of the dispenser 11 and the applied state of the liquid elastomer 5. FIG. 5A is a plan view, and FIG. 5B is a side view.

As shown in FIGS. 5A and 5B, the molten liquid elastomer (containing fine cells) 5 circulates in the dispenser 11 through the hoses 14. The on-off valve 18 is formed in a nozzle 17 of the dispenser 11. The nozzle 17 is opened by opening this on-off valve 18 by raising it by a solenoid or the like, and the circulating liquid elastomer 5 is discharged by the internal pressure of the hoses 14. By linearly moving the nozzle 17 or the vessel 1 as a work in synchronism with this discharge, the liquid elastomer 5 can be linearly applied.

The liquid elastomer 5 discharged from the nozzle 17 begins solidifying because its temperature lowers along with the expansion of the mixed fine cells, and the solidified shape is like an elastomer 19. The application amounts of this solidified elastomer 19 in the start and end portions vary more largely than the application amount in the intermediate portion (toner may leak in a portion where the application amount is small owing to these variations).

Possible causes of variations in the application amount are as follows:

- Since the liquid elastomer 5 is a medium- to high-viscosity liquid, liquid discharge does not well respond to the opening/closing action of the nozzle 17 of the dispenser 11.
- The response of opening/closing of the on-off valve 18 changes owing to, e.g., changes in frictional force during movement of the on-off valve 18.
- The tip of the nozzle 17 has a portion where the liquid does not circulate. If the liquid stays there, the viscosity of the liquid changes owing to a density difference between mixed cells.

When the liquid elastomer 5 is to be linearly applied, variations in actual discharge timings at the start and end points make it difficult to synchronize the application with the movement of the NC linear motion unit 10.

Referring to FIG. 4, an operator places the vessel 1 on the moving base of the NC linear motion unit 10 and presses a start switch (not shown). Consequently, the vessel 1 is moved by the NC linear motion unit 10, and the start point of the application area is positioned at the center of the nozzle 17 of the dispenser 11.

FIG. 6 is a sectional view showing the state in which the liquid elastomer 5 is applied to the vessel 1, and the method of application.

Referring to FIG. 6, a point A is an application start point. At this point A, the on-off valve 18 of the dispenser 11 is opened. Note that this opening of the on-off valve 18 is done under time control by a timer, and the application amount is determined by the opening time of this on-off valve 18.

With the on-off valve 18 open, the NC linear motion unit 10 is moved to apply the liquid elastomer 5 to the gap between the blade 2 and the vessel 1. The discharge amount per unit time by the opening of the on-off valve 18 is constant. Between the start point (point A) and the end point (point B), therefore, the application amount is determined by the moving speed of the NC linear motion unit 10.

When the dispenser 11 arrives at the point B as the application end point, this dispenser 11 is stopped as in the point A, and time control is performed by the timer such that the on-off valve 18 is closed after an elapse of a predetermined time.

In the above application method, the relationship between the moving velocity in the intermediate application area and the stop time in the two end portions (start and end points) of the NC linear motion unit 10 is so set as to increase the application volume in the two end portions (start and end points) in the application area of the vessel 1.

In this embodiment as described above, a recess or a projection is formed in the sealing area of the toner cartridge in a direction perpendicular to the injection direction of a liquid elastomer. Accordingly, it is possible to prevent the removal of the cured liquid elastomer and the positional deviation of the liquid elastomer caused by deformation or the like during assembly. This achieves the effect of reliably preventing a leak of toner having a fine particle size, regardless of the dimensional tolerance or assembly tolerance of parts.

Also, a recess or a projection is formed in a portion of an edge line of a gap to be filled with a liquid elastomer. This achieves the effect of reliably stopping the flow of toner by this recess or projection.

In addition, a through hole communicating with the outside is formed in a gap to be filled with a liquid elastomer to exhaust the air in this gap to the outside. This achieves the effect of ensuring high sealing properties by filling the gap well with the liquid elastomer.

Furthermore, a liquid elastomer is injected to be larger than the outer perimeter of at least one part forming a gap. This achieves the effect of reliably preventing a toner leak by the end portion of the at least one part and the liquid elastomer.

Still another embodiment of the present invention will be described below with reference to the accompanying drawings.

Figure 23:
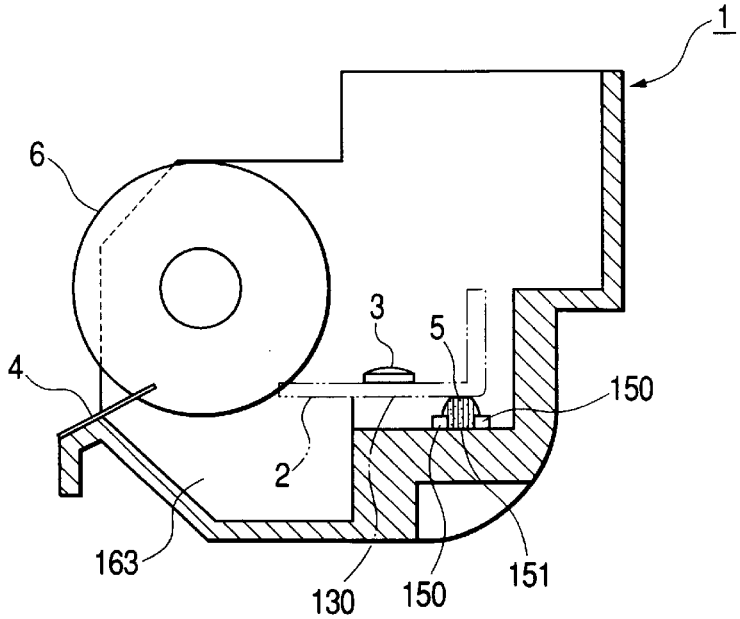
FIG. 23 is a sectional view of the vessel constructing the process cartridge of this embodiment.

FIG. 23 is a sectional view of a cleaner vessel 1 constructing a toner cartridge according to the present invention. A blade 2 indicated by the two-dot chain line is attached to the vessel 1. Two side portions of this blade 2 are fixed to the vessel 1 by machine screws 3.

A sheet 4 is adhered to the vessel 1 by a double-coated tape (not shown). When a drum 6 as an image carrier is attached to the vessel 1, the surface of this sheet 4 and an edge rubber portion of the blade 2 form a closed vessel. Waste toner (waste developer) is collected in this closed vessel.

A plastic resin molded product is used as the vessel 1, and a gap is formed between this vessel 1 and the blade 2 in relation to the molding accuracy. When this gap is formed, the waste toner (waste developer) collected in the closed vessel leaks to result in a defective product. Therefore, this leak of the waste toner is prevented by applying a liquid elastomer 5 as a sealing agent to the gap.

Figure 22:
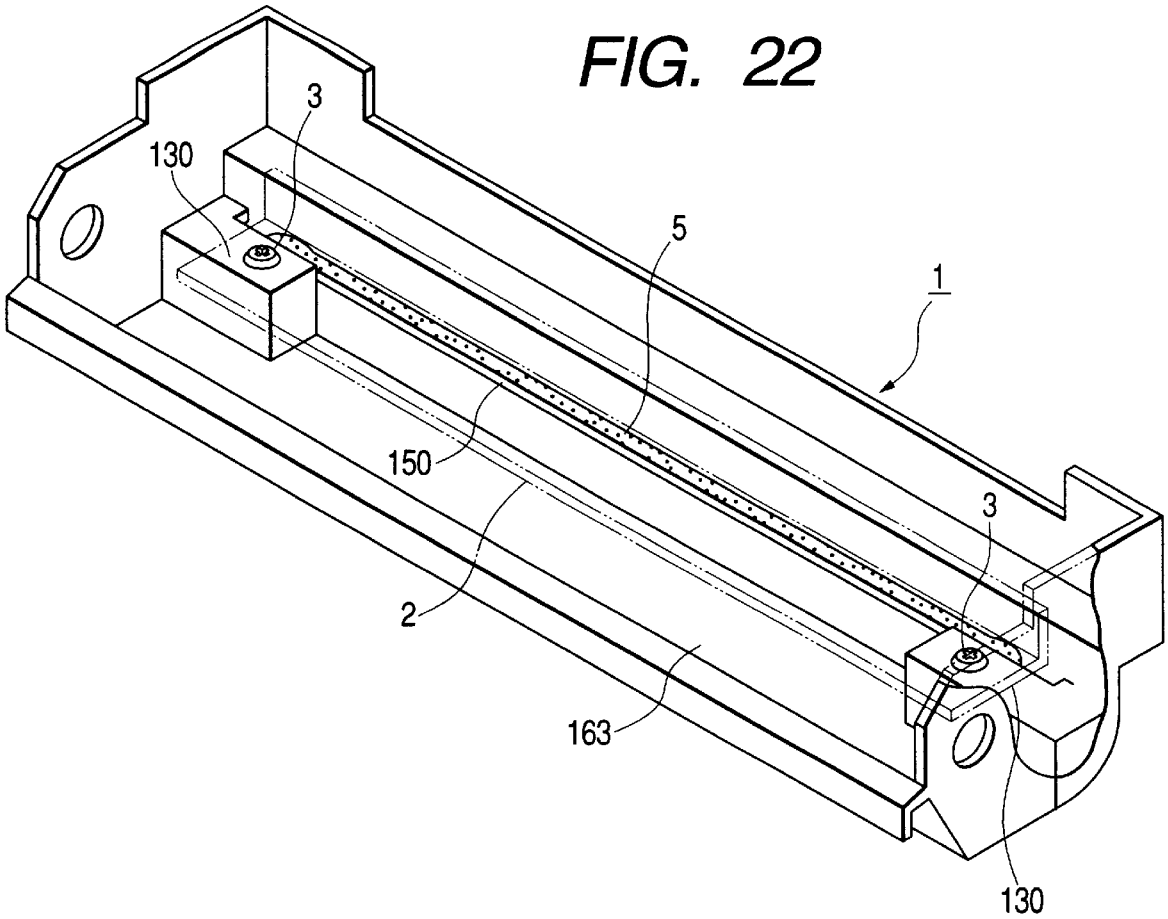
FIG. 22 is a perspective view of a vessel constructing a process cartridge of still another embodiment.

FIG. 22 is a perspective view of the cleaner vessel 1, showing the state in which the blade 2 is mounted on the vessel 1 by the machine screws 3. Mounting surfaces 130 at which this blade 2 is mounted on the vessel 1 are formed in the two side portions of the blade 2, in order to ensure a large waste toner volume and increase the adhesion to the blade 2. Although the blade 2 and the vessel 1 are closely adhered at these mounting surfaces 130, a linear gap is formed on a receiving surface along the longitudinal direction of the blade 2. Hence, the liquid elastomer 5 is applied along this gap to a portion shown in FIG. 22.

Figure 24:
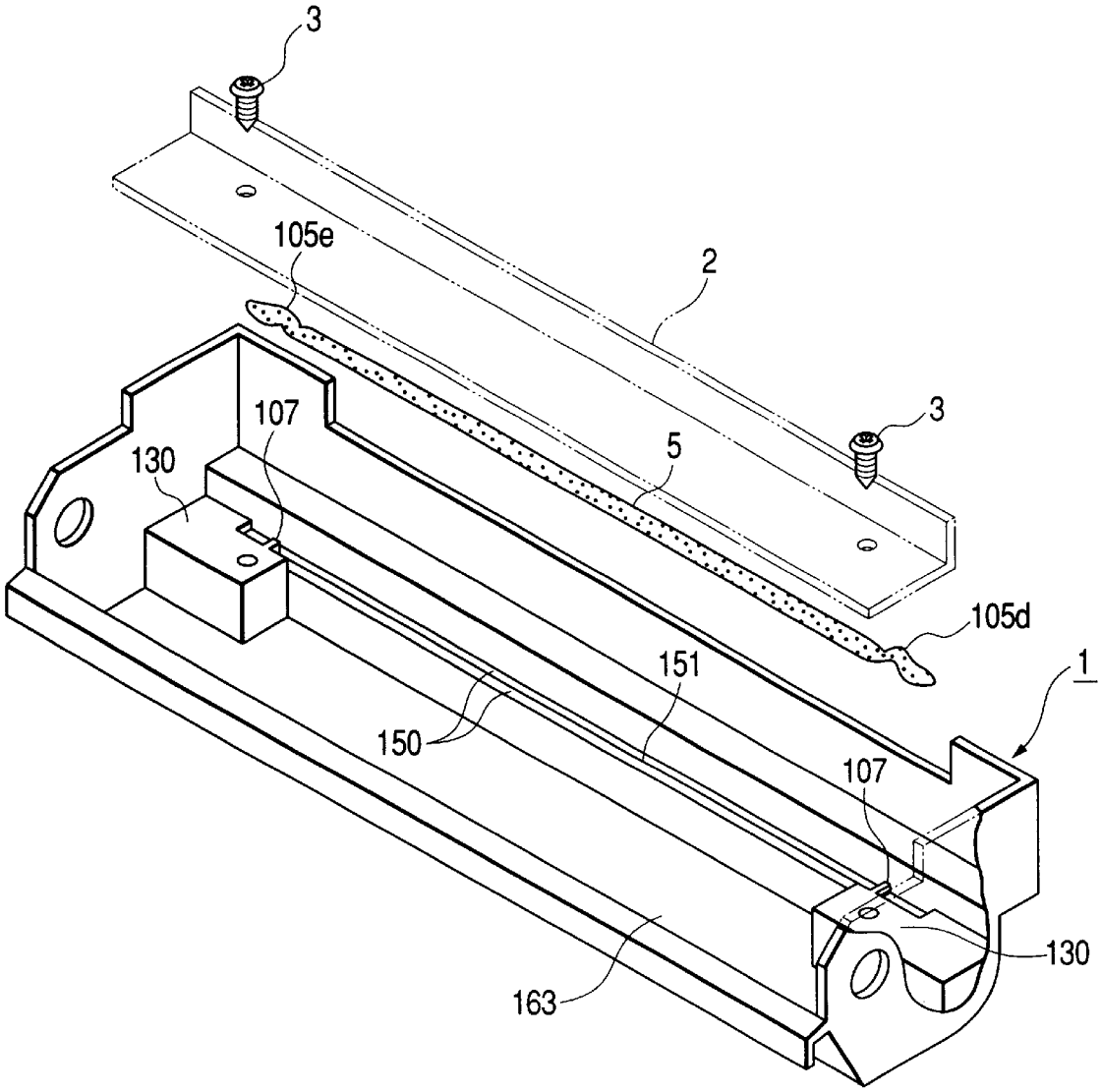
FIG. 24 is a perspective view showing the state in which a blade and the solidified shape of a liquid elastomer are separated upward from the vessel, in order to explain the application area of the liquid elastomer.

FIG. 24 shows the state in which the blade 2 and the solidified shape of the liquid elastomer 5 are separated upward from the vessel 1, in order to explain the applied state of the liquid elastomer 5 shown in FIG. 22. FIG. 24 illustrates a rib 150 for regulating the spread of the liquid elastomer 5 when it is applied, and an application surface 151 of the liquid elastomer 5.

The upper surfaces of projections 107 are flush with the blade mounting surfaces 130. Portions 5*d* and 5*e* of the liquid elastomer 5 indicate that this liquid elastomer 5 is formed on these projections 107. In this state, the blade 2 is mounted on the blade mounting surfaces 130 by the machine screws 3. Consequently, a solidified elastomer (FIGS. 25A and 25B) is sandwiched between the blade 2 and the projections 107 and the receiving surface of the vessel 1, thereby forming a waste toner chamber 163 as a closed space.

This will be described in more detail below.

Figure 26A:
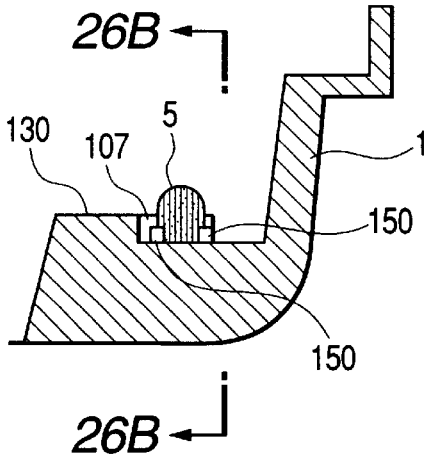
FIGS. 26A and 26B are partial sectional views showing the state in which the elastomer is applied to the vessel.
Figure 26B:
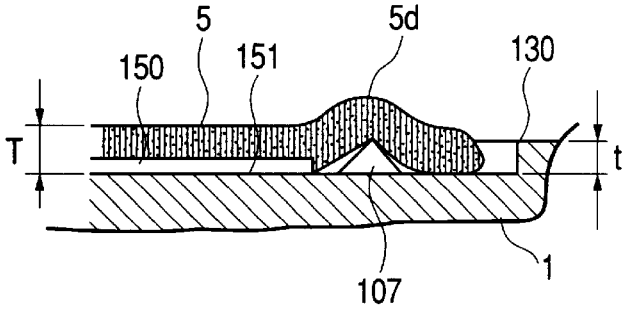

FIGS. 26A and 26B illustrate the state in which the liquid elastomer 5 is applied and solidified. FIG. 26A is a sectional view of the vessel 1 in a direction perpendicular to the application direction of the liquid elastomer 5. FIG. 26B is a sectional view taken along a line 26B—26B in FIG. 26A. Referring to FIGS. 26A and 26B, the rib 150 regulates the spread of the applied liquid elastomer 5. To prevent a toner leak, a height T of the liquid elastomer 5 after solidification must be larger than the height of the summit of the projection 107 (i.e., a height t of the blade mounting surface 130) (T>t), for the reason explained below. That is, the moment the liquid elastomer 5 is applied it is a liquid, so it spreads if there is no regulating rib 150. To assure a desired height, therefore, a larger application amount of the liquid elastomer 5 is necessary. This causes inconveniences such as a flow of the liquid elastomer 5 into the waste toner chamber.

Figure 27A:
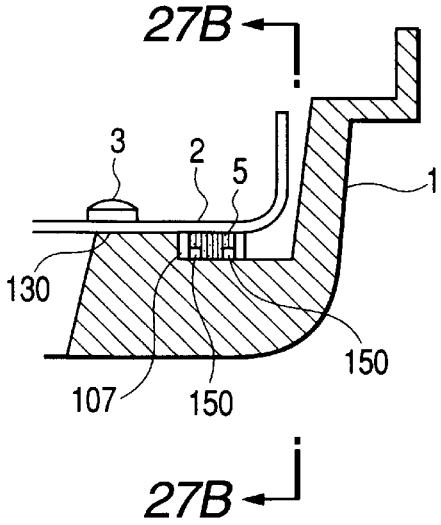
FIGS. 27A and 27B are partial sectional views showing the state in which the blade is assembled to the vessel.
Figure 27B:
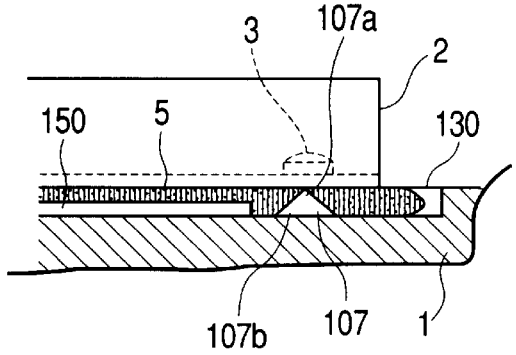

FIGS. 27A and 27B illustrate the state in which the blade 2 is mounted on the mounting surface 130 by the machine screw 3 and the solidified liquid elastomer 5 is sandwiched as it is compressed. FIG. 27A is a sectional view of the vessel 1, and FIG. 27B is a sectional view taken along a line 27B—27B in FIG. 27A.

The projection 107 has a substantially triangular section in which a summit 107*a* is narrower than a root 107*b* of the projection 107. In addition, the modulus of elasticity of the liquid elastomer 5 is small. This makes it possible to well decrease the thickness of the liquid elastomer 5 sandwiched between the blade 2 and the summit 107*a* of the projection 107 level with the blade mounting surface 130. Also, on the inclined surface of the projection 107, the liquid elastomer 5 pushed by the blade 2 spreads not only in a direction perpendicular to the inclined surface but also in the direction of the root 107*b* along the inclined surface. Accordingly, a sufficient compressing force is applied even in the vicinity of the root 107*b*, and this reliably prevents a leak of toner having a small particle size for realizing high image quality. Note that the deformation of the blade 2 mounted on the blade mounting surface 130 of the vessel 1 is also almost negligible.

When a sponge having a double-coated tape adhered is used to perform analogous sealing, the thickness is (thickness of double-coated tape+thickness of compressed sponge)=about several tens of $\mu$m to about 0.1 mm. So, a leak of high-image-quality toner having a particle size of a few $\mu$m is not completely prevented. Also, when only a sponge is used to perform similar sealing, the sponge changes its volume largely when compressed because it is an open-cell material. This forms a gap near the root 107*b* of the projection 107, so the sponge has a thickness of several tens of $\mu$m even when compressed. To further decrease the thickness, the pushing force of the blade 2 must be increased. If the pushing force of the blade 2 is increased, the deformation of this blade 2 is no longer negligible. In either case, toner leak prevention is imperfect.

Figure 28:
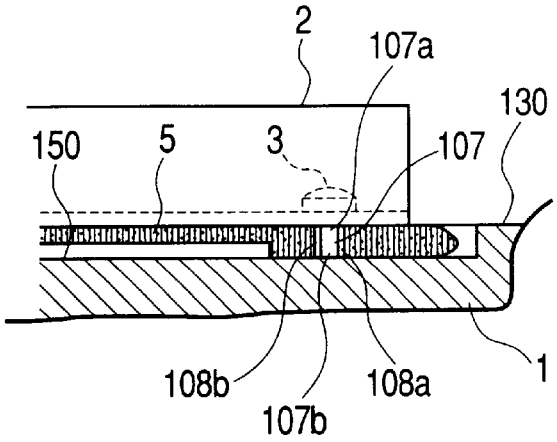
FIG. 28 is a partial sectional view for explaining inconvenience of toner sealing.

FIG. 28 is a view showing a structure in which the summit 107*a* and the root 107*b* of the projection 107 have the same dimension. Compared to FIGS. 27A and 27B, microscopic gaps are formed as indicated by 108*a* and 108*b* in the vicinity of the projection 107 as described above. This makes toner leak prevention slightly imperfect.

Figure 29:
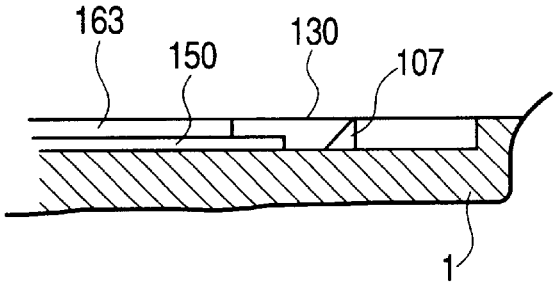
FIG. 29 is a partial sectional view of a vessel according to still another embodiment of the present invention.
Figure 30:
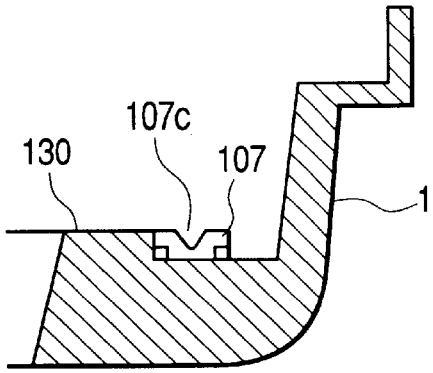
FIG. 30 is a partial sectional view showing a vessel according to still another embodiment of the present invention.

FIGS. 29 and 30 are sectional views showing other forms of the projection 107 of this embodiment. FIG. 29 shows a form in which an inclined portion of the projection 107 is formed only on the side of the waste toner chamber 163 for forming a closed space. FIG. 30 shows a form in which a substantially triangular recess 107*c* is formed in the summit of the projection 107 in order to further reduce the counterforce of the elastomer with respect to the blade 2 when the blade 2 is assembled to the vessel body.

FIG. 4 is a plan view of an applicator 15 for applying the liquid elastomer 5. This applicator 15 shown in FIG. 4 comprises a tooling unit on a table 16 on which application is performed, and a supply unit 12 of the liquid elastomer 5. The liquid elastomer 5 used in the supply unit 12 is a thermoplastic synthetic rubber material which solidifies at room temperature.

The supply unit 12 melts this rubber material by heating to 160 to 180° C. and mixes the molten rubber material with a separately supplied gas such as an inert gas, e.g., $N_2$ or $CO_2$, thereby obtaining the medium- to high-viscosity liquid elastomer 5 containing fine cells. This liquid elastomer 5 containing fine cells is supplied in the liquid state to a dispenser 11 through hoses 14 and applied. The hoses 14 are used to stably circulate the liquid elastomer 5 in the liquid state between the supply unit 12 and the dispenser 11. A heater (not shown) is formed on the entire outer circumferential surface of each hose. These hoses 14 are a supply hose and return hose for giving the liquid elastomer 5 a material temperature of 160 to 180° C. and circulating this liquid elastomer 5 held in the liquid state between the supply unit 12 and the dispenser 11. Therefore, these two hoses 14 are connected to the dispenser 11.

This dispenser 11 is fixed to a support 13 placed on the table 16. An NC linear motion unit 10 is placed on the lower surface of the dispenser 11 fixed to the support 13. The vessel 1 as a work is placed on a moving base of this NC linear motion unit 10. An on-off valve 18 (FIGS. 25A and 25B) of the dispenser 11 is opened and closed in synchronism with the movement of the NC linear motion unit 10.

Figure 25A:
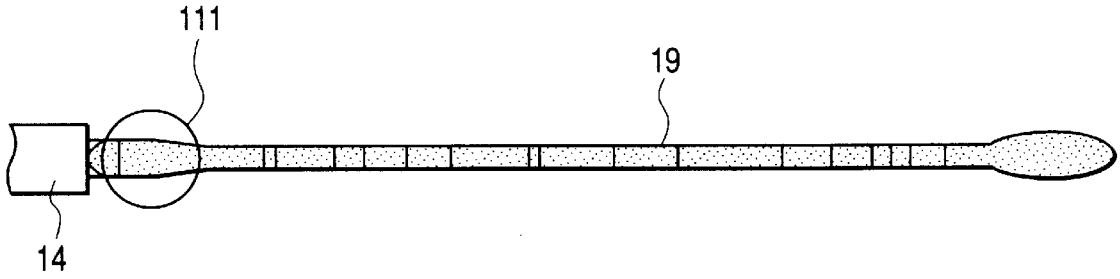
FIGS. 25A and 25B are views showing the sectional shape of a dispenser and the applied state of the liquid elastomer.
Figure 25B:
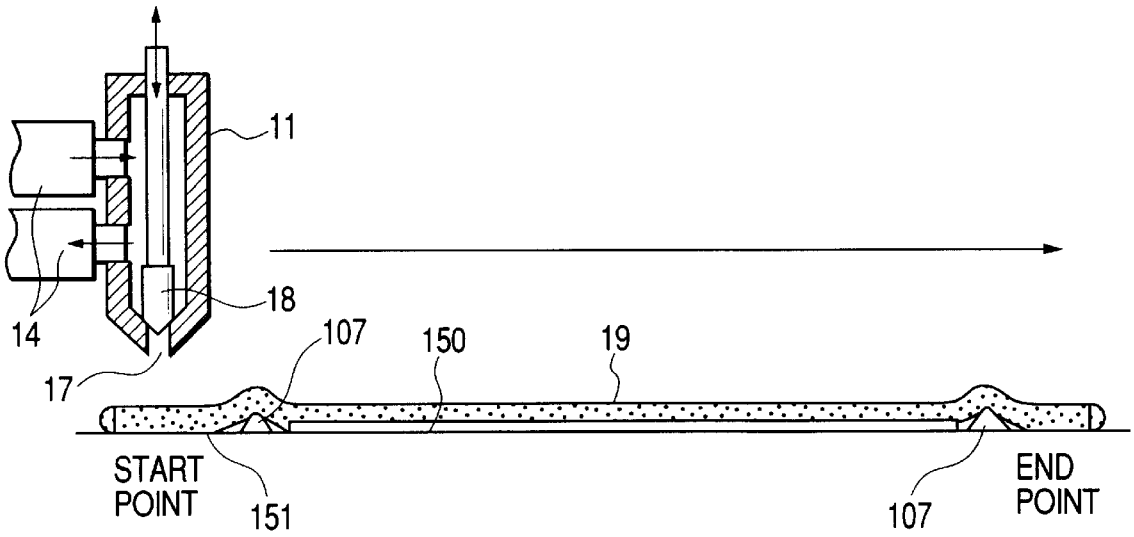

FIGS. 25A and 25B illustrate the sectional shape of the dispenser 11 and the applied state of the liquid elastomer 5. FIG. 25A is a plan view, and FIG. 25B is a side view.

The molten liquid elastomer (containing fine cells) 5 circulates in the dispenser 11 through the hoses 14. The on-off valve 18 is formed in a nozzle 17 of the dispenser 11. The nozzle 17 is opened by opening this on-off valve 18 by raising it by a solenoid or the like, and the circulating liquid elastomer 5 is discharged by the internal pressure of the hoses 14. By linearly moving the nozzle 17 or the vessel 1 as a work in synchronism with this discharge, the liquid elastomer 5 can be linearly applied.

The surface of the liquid elastomer 5 discharged from the nozzle 17 forms a smooth skin layer because the temperature lowers along with the expansion of the mixed fine cells. The interior of the liquid elastomer 5 begins solidifying while the closed cells are contained. The solidified shape is like an elastomer 19. The modulus of elasticity of this solidified elastomer 19 can be considerably decreased by increasing the ratio of the inert gas such as nitrogen gas mixed in the liquid elastomer 5 (the inert gas can be mixed in amount about three times the amount of the liquid elastomer 5 or more as a volume ratio).

Referring to FIG. 4, an operator places the vessel 1 on the moving base of the NC linear motion unit 10 and presses a start switch (not shown). Consequently, the vessel 1 is moved by the NC linear motion unit 10, and the start point of the application area is positioned at the center of the nozzle 17 of the dispenser 11.

In this embodiment as described above, at least one projection whose summit is on the same level as a part mounting surface is formed in a process cartridge. A liquid elastomer is applied and solidified on this projection, and a part is mounted on the part mounting surface, thereby compressing the solidified elastomer and ensuring high sealing properties. This achieves the effect of reliably preventing a leak of a developer to the outside of a cartridge frame.

What is claimed is:

1. A developer container comprising:

a developer containing unit containing a developer; and a sealing member supplied between a plurality of members to prevent leakage of the developer, said sealing member being a liquid elastomer, wherein, in an area in which said liquid elastomer is supplied, said sealing member has a start point where a supply of said sealing member between said plurality of the members is started and an end point where a supply of said sealing member between said plurality of members is completed, the end point being located at a point different from the start point, and wherein supply amounts of said sealing member at the start point and the end point are greater than a supply amount of said sealing member in an intermediate portion between the start point and at the end point, respectively.

2. A developer container according to claim 1, further comprising a groove into which said liquid elastomer is supplied, wherein said groove is larger at the start point and at the end point than in the intermediate portion.

3. A developer container according to claim 2, wherein a volume of said groove is larger at the start point and the end point than a volume in the intermediate portion, in a direction of a height of said groove.

4. A developer container according to claim 2, wherein a volume of said groove is larger at the start point and the end point than a volume in the intermediate portion, in a widthwise direction perpendicular to a longitudinal direction in which said liquid elastomer is supplied.

5. A developer container according to claim 2, wherein said groove comprises an inclined surface along which a size of an opening increases from a back side at which said liquid elastomer is injected toward a front side.

6. A developer container according to claim 5, wherein said inclined surface is formed along a longitudinal direction in which said liquid elastomer is supplied.

7. A developer container according to claim 5, wherein said plurality of members include a container body and a blade supported by said container body, wherein said groove is formed in a space defined by said container body and said blade, and wherein said inclined surface is formed in said container body.

8. A developer container according to claim 5, wherein said liquid elastomer is guided to a back side along said inclined surface.

9. A developer container according to claim 2, wherein said plurality of members include a container body and a blade supported by said container body, and wherein said groove is formed in a space defined by said container body and said blade.

10. A developer container according to claim 2, wherein said groove is formed in a direction perpendicular to a direction in which said liquid elastomer is injected, and includes at least one of a hole, recess, and projection into which said liquid elastomer is inserted.

11. A developer container according to claim 10, wherein said at least one of hole, recess, and projection are formed between said plurality of members.

12. A developer container according to claim 11, wherein a through hole extending to an outside of said developer container is formed in said at least one hole and recess.

13. A developer container according to claim 10, wherein a through hole extending to a outside of said developer container is formed between said plurality of members.

14. A developer container according to claim 10, wherein a length along which said liquid elastomer is supplied is larger than a length of at least one of said plurality of members.

15. A developer container according to claim 1, wherein said plurality of members include a container body and a blade supported by said container body.

16. A developer container according to any one of claims 1 to 4 and 5 to 14, wherein said developer container is formed in a cartridge, which can be installed in and removed from a main body of an image forming apparatus.

17. A developer container according to claim 16, wherein the cartridge includes an image carrier for carrying an image.

18. A developer container containing, comprising:

a developer containing unit containing a developer;

a sealing member supplied between a container body and a blade to prevent leakage of the developer, said sealing member being a liquid elastomer; and at least one of a hole, recess, and projection, which is formed in a direction perpendicular to a direction in which said liquid elastomer is injected, and into which said liquid elastomer is inserted.

19. A developer container according to claim 18, wherein said at least one of hole, recess, and projection are formed between said plurality of members.

20. A developer container according to claim 19, wherein a through hole extending to an outside of said developer container is formed in said at least one of a hole, recess, and projection.

21. A developer container according to claim 18, wherein a through hole extending to an outside of said developer container is formed between said container body and said blade.

22. A developer container according to claim 18, wherein a length along which said liquid elastomer is supplied is larger than a length of at least one of said container body and said blade.

23. A developer container according to any one of claims 18 to 22, wherein said developer container is provided in a cartridge, which can be installed in and removed from a main body of an image forming apparatus.

24. A developer container according to claim 23, wherein said cartridge includes an image carrier for carrying an image.

25. A developer container comprising:

a container body comprising a developer containing unit containing a developer; and a sealing member supplied to said container body to prevent leakage of the developer, said sealing member being a liquid elastomer, wherein said container body includes a projection formed in an area in which said liquid elastomer is supplied, and, after said liquid elastomer supplied to said projection solidifies, a blade is mounted on said container body to compress said solidified elastomer.

26. A developer container according to claim 25, wherein a height of said projection is the same as a height of a mounting surface, on which said blade is mounted, of said container body.

27. A developer container according to claim 25, wherein a top side of said projection is smaller than a bottom side of said projection thereof.

28. A developer container according to claim 25, further comprising a recess, which is formed in said projection.

29. A developer container according to any one of claims 25 to 28, wherein said developer container is provided in a cartridge, which can be installed in and removed from a main body of an image forming apparatus.

30. A developer container according to claim 29, wherein said cartridge includes an image carrier for carrying an image.

* * * * *

UNITED STATES PATENT AND TRADEMARK OFFICE

CERTIFICATE OF CORRECTION

PATENT NO. : 6,654,575 B2
DATED : November 25, 2003
INVENTOR(S) : Toshihiko Miura et al.

It is certified that error appears in the above-identified patent and that said Letters Patent is hereby corrected as shown below:

Column 3,
Line 62, “form” should read -- form of --.

Column 16,
Line 44, “a outside” should read -- an outside --;
Line 54, “1 to 4 and 5 to 14,” should read -- 1 to 14, --; and
Line 60, “containing, comprising:” should read -- comprising: --.

Column 18,
Line 16, “projection thereof.” should read -- projection. --.

Signed and Sealed this

Eleventh Day of May, 2004

JON W. DUDAS
*Acting Director of the United States Patent and Trademark Office*